US011300124B2

(12) United States Patent
Fujiwara

(10) Patent No.: US 11,300,124 B2
(45) Date of Patent: Apr. 12, 2022

(54) SINGLE-SCREW COMPRESSOR WITH A GAP ADJUSTER MECHANISM

(71) Applicant: DAIKIN INDUSTRIES, LTD., Osaka (JP)

(72) Inventor: Hideki Fujiwara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 264 days.

(21) Appl. No.: 16/496,267

(22) PCT Filed: Mar. 20, 2018

(86) PCT No.: PCT/JP2018/011210

§ 371 (c)(1),
(2) Date: Sep. 20, 2019

(87) PCT Pub. No.: WO2018/174100

PCT Pub. Date: Sep. 27, 2018

(65) Prior Publication Data

US 2020/0032800 A1 Jan. 30, 2020

(30) Foreign Application Priority Data

Mar. 21, 2017 (JP) ..... JP2017-054861

(51) Int. Cl.
*F04C 18/52* (2006.01)
*F01C 21/10* (2006.01)

(52) U.S. Cl.
CPC ..... *F04C 18/52* (2013.01); *F01C 21/102* (2013.01); *F04C 2270/175* (2013.01)

(58) Field of Classification Search
CPC ... F01C 21/102; F04C 18/52; F04C 2270/175
See application file for complete search history.

(56) References Cited

U.S. PATENT DOCUMENTS 3,180,565 A 4/1965 Zimmern
5,890,884 A 4/1999 Zimmern
(Continued)

FOREIGN PATENT DOCUMENTS

CN 105179236 A * 12/2015
CN 205349722 U 6/2016
(Continued)

OTHER PUBLICATIONS

Supplementary European Search Report of corresponding EP Application No. 18 77 1913.3 dated Dec. 17, 2020.
(Continued)

*Primary Examiner* — Mary Davis
(74) *Attorney, Agent, or Firm* — Global IP Counselors, LLP

(57) ABSTRACT

A single-screw compressor includes a screw rotor with a helical groove, a cylindrical wall rotatably housing the screw rotor, a gap adjuster mechanism, and a gear-shaped gate rotor having a plurality of flat gates. The gate rotor is arranged outside the wall. Some of the gates enter a space inside the wall via an opening formed in the cylindrical wall and mesh with the screw rotor. A fluid is compressed in a compression chamber defined in the helical move by the screw rotor, the gates meshing with the screw rotor, and the wall. The gap adjuster mechanism avoids contact between a front surface of the gate rotor toward the compression chamber and a sealing surface of the wall facing the front surface, by displacing at least one of the gate rotor and the sealing surface of the wall in an axial direction of the gate rotor.

11 Claims, 13 Drawing Sheets

(56) References Cited

U.S. PATENT DOCUMENTS

| | | | | |
|---|---|---|---|---|
| 8,523,548 | B2 * | 9/2013 | Hossain | F04C 18/52 418/195 |
| 2020/0003211 | A1 * | 1/2020 | Miyamura | F04C 18/52 |

FOREIGN PATENT DOCUMENTS

| | | | |
|---|---|---|---|
| DE | 2833292 | A1 | 2/1979 |
| FR | 1331998 | A | 7/1963 |
| JP | 6-34636 | Y2 | 9/1994 |
| JP | 11-504096 | A | 4/1999 |
| JP | 2009-174460 | A | 8/2009 |

OTHER PUBLICATIONS

International Search Report of corresponding PCT Application No. PCT/JP2018/011210 dated Jun. 19, 2018.
International Preliminary Report of corresponding PCT Application No. PCT/JP2018/011210 dated Oct. 3, 2019.

* cited by examiner

SINGLE-SCREW COMPRESSOR WITH A GAP ADJUSTER MECHANISM

CROSS-REFERENCE TO RELATED APPLICATIONS

This U.S. National stage application claims priority under 35 U.S.C. § 119(a) to Japanese Patent Application No. 2017-054861, filed in Japan on Mar. 21, 2017, the entire contents of which are hereby incorporated herein by reference.

BACKGROUND

Field of the Invention

The present invention relates to a single-screw compressor having a screw rotor and a gate rotor.

Background Information

As a conventional compressor for compressing a fluid such as a refrigerant or air, a single-screw compressor having a screw rotor provided with helical grooves, and a gate rotor configured like a gear having a plurality of plate-shaped gates that mesh with the screw rotor has been used (see Japanese Unexamined Patent Publication No. 2009-174460).

In the single-screw compressor, the screw rotor is rotatably housed in a cylindrical wall, and the gate rotors are arranged outside the cylindrical wall. Some of the gates of each gate rotor enter the internal space of the cylindrical wall through an opening formed therein to mesh with the screw rotor, so that the gate rotors rotate together with the screw rotor. The cylindrical wall, the screw rotor, and the gates meshing with the screw rotor define a compression chamber in the helical grooves. When the screw rotor is driven by an electric motor to rotate, the gates meshing with the screw rotor are pushed and move in the helical grooves from one end to the other end, thereby decreasing the capacity of the compression chamber and compressing the fluid.

In the single-screw compressor, a gap is usually formed between a front surface of the gate rotor and a sealing surface of the cylindrical wall to avoid wear of the front surface of the gate rotor toward the compression chamber caused by contact with the sealing surface of the cylindrical wall facing the front surface when the gates of the gate rotor enter in and come out of the cylindrical wall from the opening. If the gap is too large, a large amount of fluid may leak out from the compression chamber to a low-pressure space outside the cylindrical wall. The efficiency of the compressor may thus be reduced. On the other hand, if the gap is too small, the front surface of the gate rotor and the sealing surface of the cylindrical wall are brought into contact with each other, and the gate rotor may burn, when the gate rotor is thermally expanded and the thickness of the gate rotor is increased due to the temperature rise of the gate rotor during operation. Further, the contact between the front surface of the gate rotor and the sealing surface of the cylindrical wall may prevent the rotation of the gate rotor, which may result in causing a so-called screw lock in which the rotation of the screw rotor is also prevented. Therefore, in general, the gate rotor is arranged so that the distance between the front surface of the gate rotor and the sealing surface of the cylindrical wall is set to be a distance (about several tens of microns) at which the front surface of the gate rotor does not come into contact with the sealing surface of the cylindrical wall even when the gate rotor thermally expands. The gap formed between the front surface of the gate rotor and the sealing surface of the cylindrical wall in consideration of the thermal expansion minimizes the amount of fluid leaking from the compression chamber, while preventing burning of the compression mechanism.

SUMMARY

However, in the single-screw compressor described above, the temperature of the gate rotor may be significantly increased during an abnormal operation. In such a case, even if the gap is designed in consideration of the thermal expansion as described above, there is a possibility that the gate rotor is thermally expanded more than expected, and that the front surface of the gate rotor and the sealing surface of the cylindrical wall are brought into contact with each other.

In view of the foregoing, it is an object of the present invention to provide a single-screw compressor which avoids contact between a front surface of a gate rotor and a sealing surface of a cylindrical wall due to thermal expansion of the gate rotor.

A first aspect of the present invention is directed to a single-screw compressor including: a screw rotor (40) provided with a helical groove (41); a cylindrical wall (20) which houses the screw rotor (40) such that the screw rotor (40) is rotatable; and a gear-shaped gate rotor (50) having a plurality of flat gates (51) and arranged outside the cylindrical wall (20), some of the gates (51) entering a space inside the cylindrical wall (20) via an opening (29) formed in the cylindrical wall (20) and meshing with the screw rotor (40) so that the gate rotor (50) rotates together with the screw rotor (40), and a fluid being compressed in a compression chamber (37) defined in the helical groove (41) by the screw rotor (40), the gates (51) meshing with the screw rotor (40), and the cylindrical wall (20), wherein the single-screw compressor includes a gap adjuster mechanism (70) which, to avoid contact between a front surface (50*a*) of the gate rotor (50) toward the compression chamber (37) and a sealing surface (21) of the cylindrical wall (20) facing the front surface (50*a*), displaces at least one of the gate rotor (50) and the sealing surface (21) of the cylindrical wall (20) in an axial direction of the gate rotor (50).

In the first aspect, the gate rotor (50) which meshes with the screw rotor (40) rotates as the screw rotor (40) rotates. As a result, the position of the gate (51) in the helical groove (41) of the screw rotor (40) changes, the capacity of the compression chamber (37) gradually decreases, and the fluid is compressed. Frictional heat is generated at this moment because the gate rotor (50) slides with the screw rotor (40). When the distance between the front surface (50*a*) of the gate rotor (50) and the sealing surface (21) of the cylindrical wall (20) is smaller than the predetermined distance due to the thermal expansion of the gate rotor (50) caused by the frictional heat, the gap adjuster mechanism (70) displaces at least one of the gate rotor (50) and the sealing surface (21) of the cylindrical wall (20) in the axial direction of the gate rotor (50), thereby avoiding the contact between the front surface (50*a*) of the gate rotor (50) and the sealing surface (21) of the cylindrical wall (20).

A second aspect of the invention is an embodiment of the first aspect. In the second aspect, the gate rotor (50) is displaceable in the axial direction, and the gap adjuster mechanism (70) is configured to displace the gate rotor (50) in the axial direction so that a distance between the front surface (50*a*) of the gate rotor (50) and the sealing surface (21) of the cylindrical wall (20) is a predetermined distance.

In the second aspect, the gate rotor (50) which meshes with the screw rotor (40) rotates as the screw rotor (40) rotates. As a result, the position of the gate (51) in the helical groove (41) of the screw rotor (40) changes, the capacity of the compression chamber (37) gradually decreases, and the fluid is compressed. Frictional heat is generated at this moment because the gate rotor (50) slides with the screw rotor (40). When the distance between the front surface (50*a*) of the gate rotor (50) and the sealing surface (21) of the cylindrical wall (20) is smaller than the predetermined distance due to the thermal expansion of the gate rotor (50) caused by the frictional heat, the gap adjuster mechanism (70) displaces the gate rotor (50) in the axial direction, thereby adjusting the distance between the front surface (50*a*) of the gate rotor (50) and the sealing surface (21) of the cylindrical wall (20) to the predetermined distance. On the other hand, suppose that the temperature of the gate rotor (50) excessively increases in an abnormal operation, and the gate rotor (50) significantly expands, and the operating state thereafter returns to a steady state operation, causing the contraction of the gate rotor (50) and making the distance between the front surface (50*a*) of the gate rotor (50) and the sealing surface (21) of the cylindrical wall (20) greater than the predetermined distance. In such a situation, the gap adjuster mechanism (70) displaces the gate rotor (50) in the axial direction, thereby adjusting the distance between the front surface (50*a*) of the gate rotor (50) and the sealing surface (21) of the cylindrical wall (20) to the predetermined distance. In this manner, the gap adjuster mechanism (70) displaces the gate rotor (50) in the axial direction according to an increase and a decrease in the distance between the front surface (50*a*) of the gate rotor (50) and the sealing surface (21) of the cylindrical wall (20), thereby adjusting the distance between the front surface (50*a*) of the gate rotor (50) and the sealing surface (21) of the cylindrical wall (20) to an appropriate distance.

A third aspect of the invention is an embodiment of the second aspect. In the third aspect, the gap adjuster mechanism (70) includes: a first cylinder chamber (73) on which a first pressure acts, the first pressure varying according to an increase or a decrease in the distance between the front surface (50*a*) of the gate rotor (50) and the sealing surface (21) of the cylindrical wall (20); a second cylinder chamber (74) on which a second pressure acts, the second pressure being constant; and a piston (75) provided between the first cylinder chamber (73) and the second cylinder chamber (74) so as to be displaceable in an arrangement direction of the first and second cylinder chambers (73, 74), and the gate rotor (50) is configured to be displaced in the axial direction in association with displacement of the piston (75).

In the third aspect, when the distance between the front surface (50*a*) of the gate rotor (50) and the sealing surface (21) of the cylindrical wall (20) varies, the first pressure acting on the first cylinder chamber (73) varies, causing the forces acting on the piston (75) to be unbalanced. As a result, the piston (75) is displaced, and the gate rotor (50) is displaced in the axial direction in association with the displacement of the piston (75). The distance between the front surface (50*a*) of the gate rotor (50) and the sealing surface (21) of the cylindrical wall (20) is adjusted to the predetermined distance in this manner.

A fourth aspect of the invention is an embodiment of the third aspect. In the fourth aspect, the gap adjuster mechanism (70) further includes: a first passage (81) connecting the first cylinder chamber (73) and a gap between the front surface (50*a*) of the gate rotor (50) and the sealing surface (21) of the cylindrical wall (20); a high pressure fluid passage (83) in which a fluid in a high pressure state flows; and a pressure regulating valve (85, 87) provided at the high pressure fluid passage (83) so as to adjust a pressure of the fluid flowing in the high pressure fluid passage (83) to a constant high pressure, and the first passage (81) is connected to a downstream side of the pressure regulating valve (85, 87) of the high pressure fluid passage (83) via a throttle (86).

In the fourth aspect, a fluid in the high pressure fluid passage (83), the pressure of which fluid is adjusted by the pressure regulating valve (85, 87) to a constant high pressure, is supplied via the throttle (86) to the first passage (81) connecting the first cylinder chamber (73) and the gap between the front surface (50*a*) of the gate rotor (50) and the sealing surface (21) of the cylindrical wall (20). The first pressure acts on the first cylinder chamber (73) in this manner. A greater amount of fluid in the first passage (81) flows into the gap between the front surface (50*a*) of the gate rotor (50) and the sealing surface (21) of the cylindrical wall (20) as the gap increases, which reduces the first pressure acting on the first cylinder chamber (73). On the other hand, a smaller amount of fluid in the first passage (81) flows into the gap between the front surface (50*a*) of the gate rotor (50) and the sealing surface (21) of the cylindrical wall (20) as the gap becomes smaller, which increases the first pressure acting on the first cylinder chamber (73). In this manner, the first pressure acting on the first cylinder chamber (73) varies according to an increase and a decrease in the gap between the front surface (50*a*) of the gate rotor (50) and the sealing surface (21) of the cylindrical wall (20).

A fifth aspect of the invention is an embodiment of the fourth aspect. In the fifth aspect, the gap adjuster mechanism (70) further includes a second passage (82) connecting the second cylinder chamber (74) to the downstream side of the pressure regulating valve (85) of the high pressure fluid passage (83), and the pressure regulating valve (85) is configured to adjust the pressure of the fluid flowing in the high pressure fluid passage (83) to the second pressure.

In the fifth aspect, the fluid in the high pressure fluid passage (83), the pressure of which fluid is adjusted to the second pressure by the pressure regulating valve (85), is supplied to the second cylinder chamber (74) via the second passage (82). The pressure acting on the second cylinder chamber (74) is maintained at the constant second pressure in this manner.

A sixth aspect of the invention is an embodiment of the fourth aspect, in the sixth aspect, the gap adjuster mechanism (70) further includes: a second passage (82) connecting the second cylinder chamber (74) to an upstream side of the pressure regulating valve (87) of the high pressure fluid passage (83); and a second pressure regulating valve (85) provided at the second passage (82) so as to maintain a pressure of the fluid flowing in the second passage (82) at the second pressure.

In the sixth aspect, the fluid in the second passage (82), the pressure of which fluid is adjusted to the second pressure by the second pressure regulating valve (85), is supplied to the second cylinder chamber (74). The pressure acting on the second cylinder chamber (74) is maintained at the constant second pressure in this manner.

A seventh aspect of the invention is an embodiment of any one of the third to sixth aspects. In the seventh aspect, the single-screw compressor further including: a support member (55) supporting the gate rotor (50) from a back side opposite to the compression chamber (37); and a holder (26)

which rotatably supports the support member (55) and is displaceable in the axial direction of the gate rotor (50), wherein the first and second cylinder chambers (73, 74) are provided on an outer periphery of the holder (26) and arranged in the axial direction of the gate rotor (50), and the piston (75) is integrated with the holder (26).

In the seventh aspect, when the first pressure varies according to an increase or a decrease in the distance between the front surface (50*a*) of the gate rotor (50) and the sealing surface (21) of the cylindrical wall (20), the holder (26) integrated with the piston (75) is displaced in the axial direction of the gate rotor (50) together with the piston (75). As a result, the support member (55) rotatably supported by the holder (26) and the gate rotor (50) are displaced in the axial direction of the gate rotor (50), thereby adjusting the distance between the front surface (50*a*) of the gate rotor (50) and the sealing surface (21) of the cylindrical wall (20) to the predetermined distance.

An eighth aspect of the invention is an embodiment of the first aspect. In the eighth aspect, the gap adjuster mechanism (70) includes a detection section (41*a*, 41*b*, 112, 128) which detects a distance between the front surface (50*a*) of the gate rotor (50) and the sealing surface (21) of the cylindrical wall (20) or a physical quantity correlating to the distance, and the gap adjuster mechanism (70) is configured to displace at least one of the gate rotor (50) and the sealing surface (21) of the cylindrical wall (20) in the axial direction of the gate rotor (50), based on a value detected by the detection section (41*a*, 41*b*, 112, 128) in order to avoid contact between the front surface (50*a*) of the gate rotor (50) and the sealing surface (21) of the cylindrical wall (20).

In the eighth aspect, when the front surface (50*a*) of the gate rotor (50) approaches the sealing surface (21) of the cylindrical wall (20) due to the thermal expansion of the gate rotor (50), the gap adjuster mechanism (70) displaces at least one of the gate rotor (50) and the sealing surface (21) of the cylindrical wall (20) in the axial direction of the gate rotor (50), based on a value detected by the detection section (41*a*, 41*b*, 112, 128), thereby automatically avoiding the contact between the front surface (50*a*) of the gate rotor (50) and the sealing surface (21) of the cylindrical wall (20). The detection section (41*a*, 41*b*, 112, 128) detects the distance between the front surface (50*a*) of the gate rotor (50) and the sealing surface (21) of the cylindrical wall (20) or a physical quantity correlating to the distance.

According to the first aspect, the gap adjuster mechanism (70) is provided which displaces at least one of the gate rotor (50) and the sealing surface (21) of the cylindrical wall (20) in the axial direction of the gate rotor (50), thereby avoiding the contact between the front surface (50*a*) of the gate rotor (50) and the sealing surface (21) of the cylindrical wall (20). Thus, even when the front surface (50*a*) of the gate rotor (50) approaches the sealing surface (21) of the cylindrical wall (20) due to the thermal expansion of the gate rotor (50), the gap adjuster mechanism (70) displaces at least one of the gate rotor (50) and the sealing surface (21) of the cylindrical wall (20) in the axial direction of the gate rotor (50), thereby avoiding the contact between the front surface (50*a*) of the gate rotor (50) and the sealing surface (21) of the cylindrical wall (20).

According to the second aspect, the gate rotor (50) is configured to be displaceable in the axial direction. In addition, the gap adjuster mechanism (70) is provided which changes the position of the gate rotor (50) in the axial direction according to the distance between the front surface (50*a*) of the gate rotor (50) and the sealing surface (21) of the cylindrical wall (20), thereby adjusting the distance to a predetermined distance. Thus, even when the distance between the front surface (50*a*) of the gate rotor (50) and the sealing surface (21) of the cylindrical wall (20) is deviated from the appropriate distance due to the thermal expansion of the gate rotor (50), the gate rotor (50) is displaced in the axial direction by the gap adjuster mechanism (70), allowing the distance to be adjusted to the appropriate distance. That is, the gap between the front surface (50*a*) of the gate rotor (50) and the sealing surface (21) of the cylindrical wall (20) can be maintained at an appropriate gap. It is therefore possible, during operation, to prevent a large amount of fluid from leaking out of the compression chamber (37) due to a large gap, and to prevent the occurrence of the screw lock caused by the closure of the gap.

According to the third embodiment, the gap adjuster mechanism (70) includes: the first cylinder chamber (73) on which the first pressure acts (the first pressure varies according to the increase and decrease of the distance between the front surface (50*a*) of the gate rotor (50) and the sealing surface (21) of the cylindrical wall (20)); the second cylinder chamber (74) on which the constant second pressure acts; and the piston (75) arranged between the first and second cylinder chambers (73, 74) so as to be displaceable. In addition, the gate rotor (50) is displaceable in the axial direction in association with the displacement of the piston (75). Thus, when the distance between the front surface (50*a*) of the gate rotor (50) and the sealing surface (21) of the cylindrical wall (20) increases or decreases, the first pressure acting on the first cylinder chamber (73) increases or decreases and the forces acting on the piston (75) are unbalanced. As a result, the piston (75) is displaced, and the gate rotor (50) is driven in association with the displacement of the piston (75). Thus, the third aspect of the invention allow s the distance between the front surface (50*a*) of the gate rotor (50) and the sealing surface (21) of the cylindrical wall (20) to be automatically adjusted to the predetermined distance by a simple configuration.

The fourth aspect provides: the first passage (81) connecting the first cylinder chamber (73) and the gap between the front surface (50*a*) of the gate rotor (50) and the sealing surface (21) of the cylindrical wall (20); the high pressure fluid passage (83) through which the fluid in the high pressure state flows; and the pressure regulating valve (85, 87) which adjusts the pressure of the fluid flowing in the high pressure fluid passage (83) to a constant high pressure, in which the first passage (81) is connected to the downstream side of the pressure regulating valve (85, 87) of the high pressure fluid passage (83) via the throttle (86). In this configuration, the fluid in the high pressure fluid passage (83) after the pressure adjustment to the constant high pressure by the pressure regulating valve (85) is supplied to the first passage (81) through the throttle (86). The fluid that has flowed into the first passage (81) is supplied to the first cylinder chamber (73) and also leaks to the gap all the time, because the first passage (81) connects between the gap and the first cylinder chamber (73). The amount of the fluid leaking from the first passage (81) to the gap varies according to the increase or decrease in the size of the gap. In association with this variation, the first pressure acting on the first cylinder chamber (73) varies as well. Thus, according to the third aspect of the invention, the first cylinder chamber (73) on which the first pressure (which varies according to the increase or decrease of the distance between the front surface (50*a*) of the gate rotor (50) and the sealing surface (21) of the cylindrical wall (20)) acts can be achieved by a simple configuration. That is, the gap adjuster mechanism (70) can be easily achieved which adjusts the distance between the front surface (50*a*) of the gate rotor (50) and the sealing surface (21) of the cylindrical wall (20) to the predetermined distance.

The fifth aspect of the invention provides the second passage (82) connecting the second cylinder chamber (74) to the downstream side of the pressure regulating valve (85) of the high pressure fluid passage (83), and the pressure regulating valve (85) is set so that the pressure of the fluid flowing through the high pressure fluid passage be adjusted to the second pressure. According to this configuration, the second cylinder chamber (74) on which the constant second pressure acts can be achieved by a simple configuration. That is, the gap adjuster mechanism (70) can be easily achieved which adjusts the distance between the front surface (50*a*) of the gate rotor (50) and the sealing surface (21) of the cylindrical wall (20) to the predetermined distance.

The sixth aspect of the invention provides the second passage (82) connecting the second cylinder chamber (74) to the upstream side of the pressure regulating valve (87) of the high pressure fluid passage (83), and the second pressure regulating valve (85) which maintains the pressure of the fluid flowing through the second passage (82) at the second pressure. According to this configuration, the second cylinder chamber (74) on which the constant second pressure acts can be achieved by a simple configuration. That is, the gap adjuster mechanism (70) can be easily achieved which adjusts the distance between the front surface (50*a*) of the gate rotor (50) and the sealing surface (21) of the cylindrical wall (20) to the predetermined distance.

According to the seventh aspect of the invention, the holder (26) which rotatably supports the support member (55) of the gate rotor (50) is configured to be displaceable in the axial direction of the gate rotor (50), and the first and second cylinder chambers (73, 74) are arranged in the axial direction of the gate rotor (50) on the outer periphery of the holder (26). Moreover, the piston (75) is integrated with the holder (26). This configuration allows the piston (75), the holder (26) integrated with the piston (75), the support member (55) rotatably supported by the holder (26), and the gate rotor (50) supported by the support member (55) from the back side, to be displaced in the axial direction of the gate rotor (50) in an integrated manner when the distance between the front surface (50*a*) of the gate rotor (50) and the sealing surface (21) of the cylindrical wall (20) varies. As a result, the distance between the front surface (50*a*) of the gate rotor (50) and the sealing surface (21) of the cylindrical wall (20) can be adjusted to the predetermined distance. In this manner, the holder (26) integrated with the gate rotor (50) via the support member (55) is integrated with the piston (75), and the gate rotor (50) is therefore displaced together with the support member (55) and the holder (26) in association with the displacement of the cylinder (72). This configuration allows the gate rotor (50) to be easily displaced in the axial direction for the adjustment of the gap.

According to the eighth aspect of the invention, when the front surface (50*a*) of the gate rotor (50) approaches the sealing surface (21) of the cylindrical wall (20) due to the thermal expansion of the gate rotor (50), the gap adjuster mechanism (70) displaces at least one of the gate rotor (50) and the sealing surface (21) of the cylindrical wall (20) in the axial direction of the gate rotor (50), based on a value detected by the detection section (41*a*, 41*b*, 112, 128), thereby automatically avoiding the contact between the front surface (50*a*) of the gate rotor (50) and the sealing surface (21) of the cylindrical wall (20). The detection section (41*a*, 41*b*, 112, 128) detects the distance between the front surface (50*a*) of the gate rotor (50) and the sealing surface (21) of the cylindrical wall (20) or a physical quantity correlating to the distance.

DETAILED DESCRIPTION OF EMBODIMENT(S)

Embodiments of the present invention will be described in detail with reference to the drawings. Note that the following embodiments and variations are merely beneficial examples in nature, and are not intended to limit the scope, applications, or use of the invention.

First Embodiment

A single-screw compressor (1) of a first embodiment (which will be hereinafter simply referred to as a "screw compressor") is provided in a refrigerant circuit of a refrigeration apparatus to compress a refrigerant. That is, the screw compressor (1) of this embodiment sucks and compresses the refrigerant which is fluid.

—General Configuration of Screw Compressor—

Figure 1:
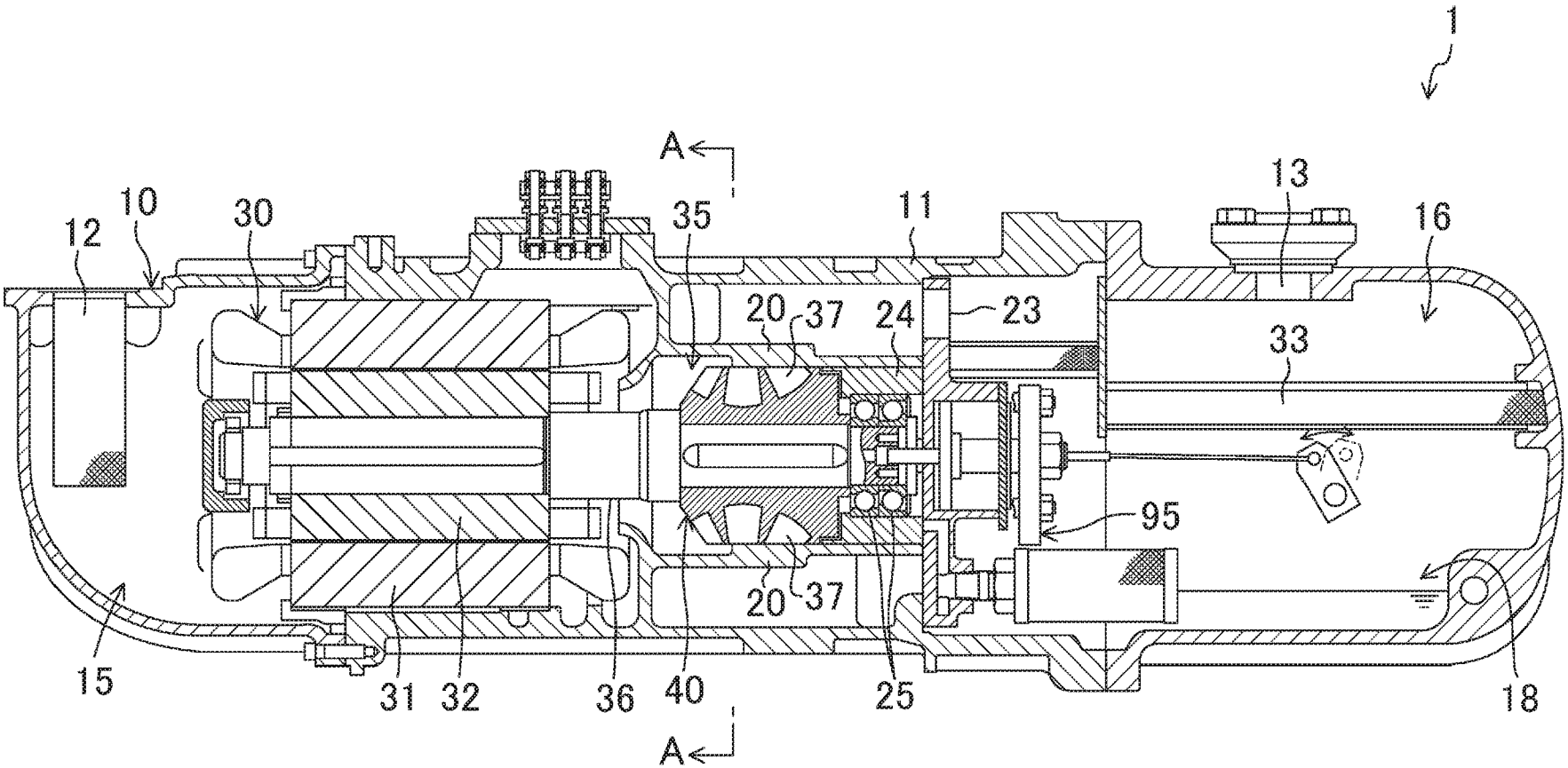
FIG. 1 is a longitudinal cross-sectional view of a single-screw compressor according to a first embodiment.

As shown in FIG. 1, in the screw compressor (1), a compression mechanism (35) and an electric motor (30) driving the compression mechanism (35) are housed in a single casing (10). The screw compressor (1) is configured as a semi-hermetic compressor.

The casing (10) is comprised of a casing body (11) and a cylindrical wall (20).

The casing body (11) is in the shape of a laterally oriented cylinder with both ends closed. An internal space of the casing body (11) is divided into a low pressure space (15) located at one end of the casing body (11) and a high pressure space (16) located at the other end of the casing body (11). The casing body (11) is provided with a suction port (12) communicating with the low pressure space (15), and a discharge port (13) communicating with the high pressure space (16). A low pressure refrigerant flowing from an evaporator of the refrigeration apparatus flows into the low pressure space (15) through the suction port (12). A high pressure refrigerant compressed and discharged from the compression mechanism (35) to the high pressure space (16) is supplied to a condenser of the refrigeration apparatus through the discharge port (13).

Inside the casing body (11), the electric motor (30) is arranged in the low pressure space (15), and the compression mechanism (35) is arranged between the low pressure space (15) and the high pressure space (16). The electric motor (30) is disposed between the suction port (12) of the casing body (11) and the compression mechanism (35). A stator (31) of the electric motor (30) is fixed to the casing body (11). A rotor (32) of the electric motor (30) is connected to a drive shaft (36) of the compression mechanism (35). When the electric motor (30) is energized, the rotator (32) rotates, and a screw rotor (40) of the compression mechanism (35), which will be described later, is driven by the electric motor (30).

Inside the casing body (11), an oil separator (33) is disposed in the high pressure space (16). The oil separator (33) separates refrigerating machine oil from the high pressure refrigerant discharged from the compression mechanism (35). An oil reservoir chamber (18) for storing the refrigerating machine oil, which is a lubricant, is formed in the high pressure space (16) below the oil separator (33). The refrigerating machine oil separated from the refrigerant in the oil separator (33) flows downward and accumulates in the oil reservoir chamber (18).

Figure 2:
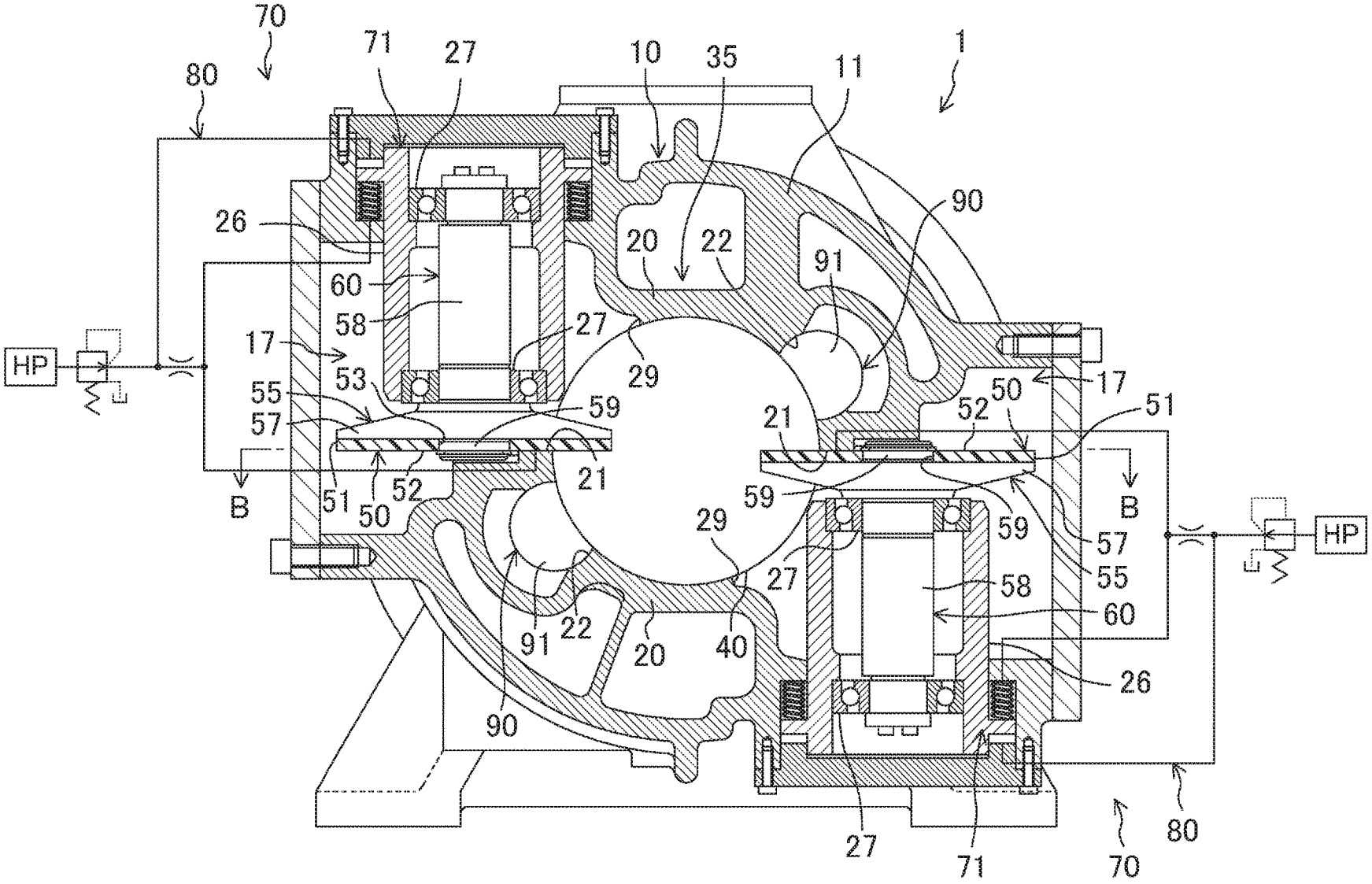
FIG. 2 is a cross-sectional view taken along line A-A in FIG. 1, illustrating the single-screw compressor.

As shown in FIGS. 1 and 2, the cylindrical wall (20) is made of a substantially cylindrical, thick member. The cylindrical wall (20) is disposed at a center portion in the longitudinal direction of the casing body (11), and is integrated with the casing body (11). An inner peripheral surface of the cylindrical wall (20) is a cylindrical surface.

A single screw rotor (40) is inserted in the cylindrical wall (20). The drive shaft (36) is coaxially connected to the screw rotor (40). Two gate rotor assemblies (60) mesh with the screw rotor (40). The screw rotor (40) and the gate rotor assemblies (60) constitute the compression mechanism (35).

The casing (10) is provided with a bearing fixing plate (23) serving as a partition wall. The bearing fixing plate (23) is substantially in the shape of a disk, and is disposed to cover an open end of the cylindrical wall (20) toward the high pressure space (16). A bearing holder (24) is attached to the bearing fixing plate (23). The bearing holder (24) is fitted in an end portion (an end portion toward the high pressure space (16)) of the cylindrical wall (20). A ball bearing (25) for supporting the drive shaft (36) is fitted in the bearing holder (24).

Figure 3:
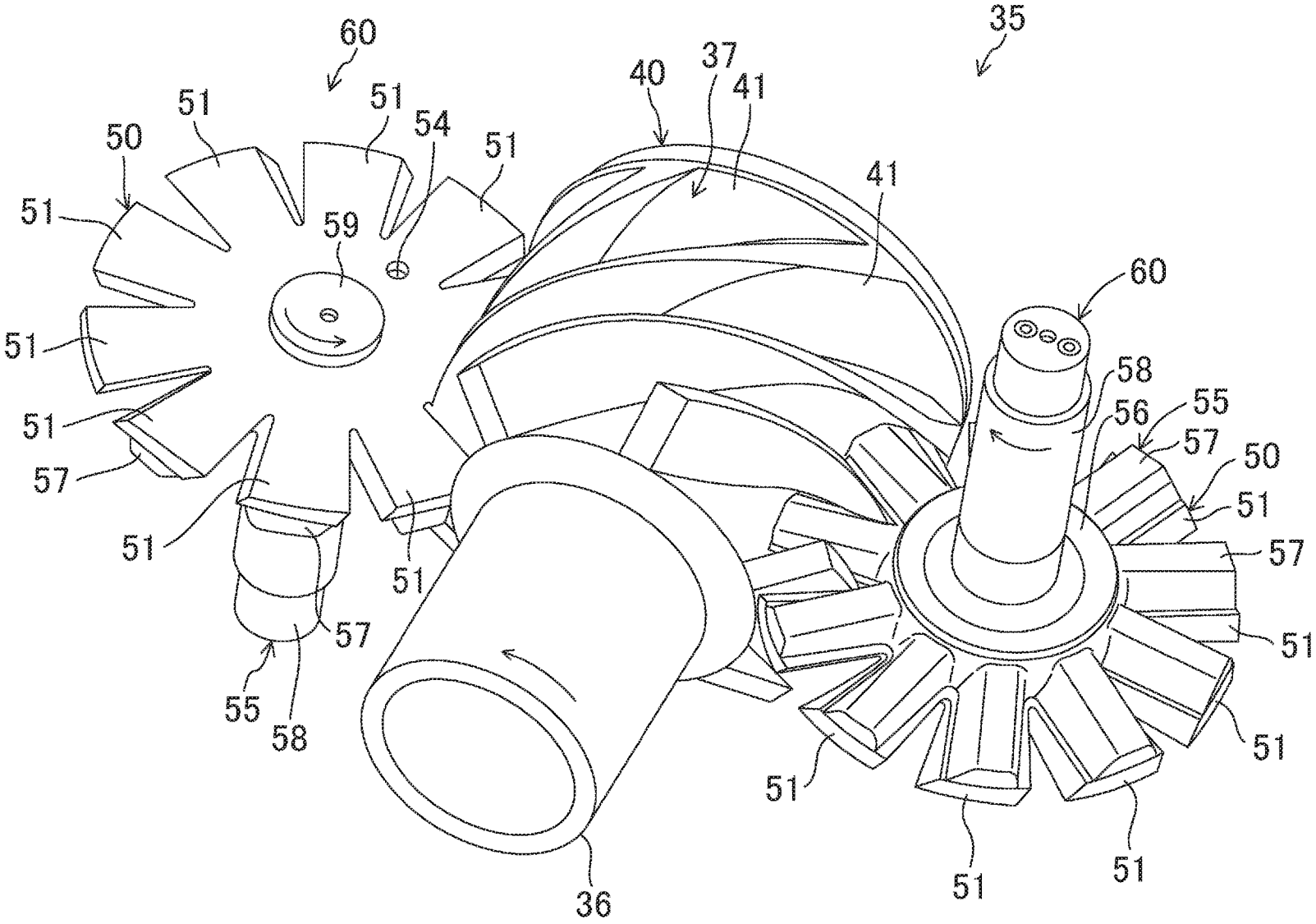
FIG. 3 is a perspective view illustrating a screw rotor and gate rotor assemblies meshing with each other.

As shown in FIG. 3, the screw rotor (40) is a metal member which is substantially in the shape of a cylindrical column. The screw rotor (40) is rotatably fitted in the cylindrical wall (20), and its outer peripheral surface is in sliding contact with the inner peripheral surface of the cylindrical wall (20).

A plurality of helical grooves (41) is formed in an outer periphery of the screw rotor (40). Each of the helical grooves (41) is a recessed groove that opens at the outer peripheral surface of the screw rotor (40), and helically extends from one end of the screw rotor (40) to the other. Each of the helical grooves (41) of the screw rotor (40) has a starting end toward the low pressure space (15), and a terminal end toward the high pressure space (16).

As will be described in detail later, each of the gate rotor assemblies (60) includes a gate rotor (50) and a support member (55). The gate rotor (50) is a plate-shaped member having a plurality of (11 in this embodiment) gates (51) each having approximately a rectangular shape and arranged in a radial fashion. The gate rotor (50) is made of a hard resin. The gate rotor (50) is attached to the support member (55) made of metal.

In the casing (10), gate rotor chambers (17) are respectively formed on the left and right sides of the cylindrical wall (20) in FIG. 2. The gate rotor assemblies (60) are respectively housed in the gate rotor chambers (17). Each of the gate rotor chambers (17) communicates with the low pressure space (15).

Specifically, a bearing holder (26) is provided in each of the gate rotor chambers (17). The bearing holder (26) is a metallic member which is generally cylindrical, and is held by the peripheral wall (11*a*) of the casing body (11) and the projecting portion (28*b*) of the lid (28) so as to be displaceable in the axial direction of the gate rotor (50). Each of the gate rotor assemblies (60) has a shaft (58), which will be described later, rotatably supported by the bearing holder (26) via a ball bearing (27).

Figure 4:
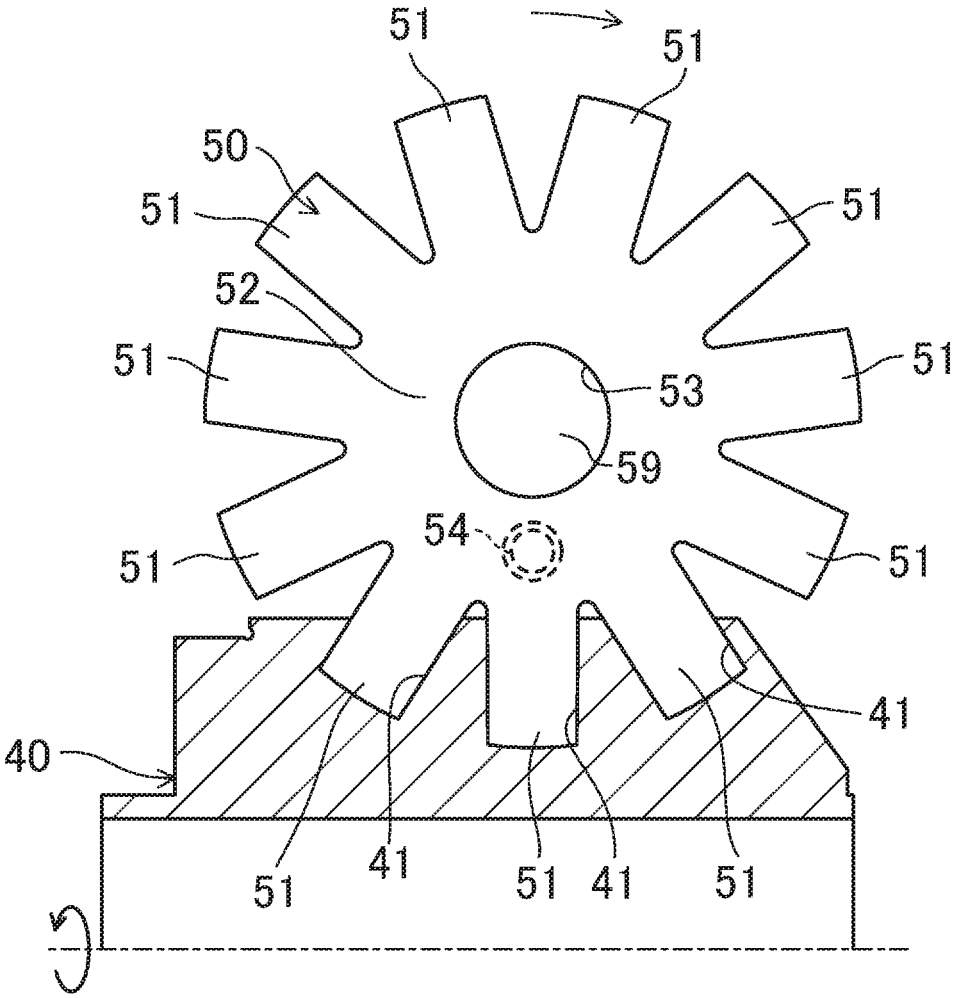
FIG. 4 is a cross-sectional view taken along line B-B in FIG. 2, illustrating the screw rotor and one of the gate rotor assemblies.

The gate rotor assembly (60) is configured such that some of the gates (51) of the gate rotor (50) enter into the helical grooves (41) of the screw rotor (40) inside the cylindrical wall (20) through the opening (29) formed in the cylindrical wall (20) from the outside of the cylindrical wall (20) (see FIG. 4). The gate rotor assembly (60) rotates together with the screw rotor (40) due to the gate rotors (50) meshing with the screw rotor (40). A portion of the wall surface of the cylindrical wall (20) of the casing (10), through which portion the gate rotor assembly (60) passes through, constitutes a sealing surface (21) that faces a front surface (50*a*) of the gate rotor (50) (see FIGS. 4 and 5). The sealing surface (21) is a flat surface extending in an axial direction of the screw rotor (40) along the outer periphery of the screw rotor (40), and faces the front surface (50*a*) of the gate rotor (50) with a space therebetween.

In the compression mechanism (35), the inner peripheral surface of the cylindrical wall (20), the helical grooves (41) of the screw rotor (40), and the gates (51) of the gate rotors (50) surround the compression chamber (37). When the screw rotor (40) rotates, the gate (51) of the gate rotor (50) relatively moves from the starting end to terminal end of an associated one of the helical grooves (41), which changes the volume of the compression chamber (37) to compress the refrigerant in the compression chamber (37).

As shown in FIG. 2, a slide valve (90) for capacity regulation is provided for each of the gate rotors of the screw compressor (1). Specifically, the screw compressor (1) is provided with the same number of slide valves (90) as the gate rotors (two in this embodiment).

The slide valves (90) are attached to the cylindrical wall (20). The cylindrical wall (20) has a hollow (22) extending in its axial direction. The slide valve (90) is arranged so that a valve body (91) thereof fits in the hollow (22) of the cylindrical wall (20). A front surface of the valve body (91) faces a peripheral surface of the screw rotor (40). The slide valve (90) is slidable in the axial direction of the cylindrical wall (20). In addition, a portion of the hollow (22) of the cylindrical wall (20) closer to the bearing holder (24) than the valve body (91) of the slide valve (90) serves as a discharge port through which the compressed refrigerant is delivered out of the compression chamber (37).

Although not shown, a rod of a slide valve drive mechanism (95) is connected to each of the slide valves (90). The slide valve drive mechanism (95) is a mechanism for driving each of the slide valves (90) so that the slide valve (90) moves in the axial direction of the cylindrical wall (20). Each slide valve (90) is driven by the slide valve drive mechanism (95), and reciprocates in the axial direction of the slide valve (90).

—Gate Rotor Assembly—

<Configuration of Gate Rotor Assembly>

As described above, each of the gate rotor assemblies (60) includes the gate rotor (50) and the support member (55). The configuration of the gate rotor assembly (60) will be described in detail below.

As shown in FIGS. 3 and 4, the gate rotor (50) is a resin member which is generally in the shape of a disk. The gate rotor (50) is provided with a center hole (53) which is a round through hole coaxial with the center axis of the gate rotor. The gate rotor (50) includes a round base (52) having the center hole (53) formed therein, and a plurality of (11 in this embodiment) gates (51) each of which is generally in a rectangular shape. The gates (51) of the gate rotor (50) extend radially outward from the outer periphery of the base (52), and are arranged at equiangular intervals in a circumferential direction of the base (52).

As shown in FIGS. 2 and 3, the support member (55) includes a disk portion (56), gate supports (57), a shaft (58), and a center protrusion (59). The disk portion (56) is in the shape of a somewhat thick disk. The gate supports (57) are provided only in the same number (11 in this embodiment) as the gates (51) of the gate rotor (50), and extend radially outward from the outer periphery of the disk portion (56). The gate supports (57) are arranged at equiangular intervals in the circumferential direction of the disk portion (56). The shaft (58) is in a circular rod shape and stands upright on the disk portion (56). The shaft (58) has a center axis which coincides with the center axis of the disk portion (56). The center protrusion (59) is provided on a surface of the disk portion (56) opposite to the shaft (58). The center protrusion (59) is in the shape of a short cylindrical column, and is arranged coaxially with the disk portion (56). An outer diameter of the center protrusion (59) is substantially equal to an inner diameter of the center hole (53) of the gate rotor (50).

The gate rotor (50) is attached to the support member (55). The center protrusion (59) fitted into the center hole (53) of the gate rotor (50) makes the support member (55) substantially unable to move in the radial direction. On the back surface (51*b*) of the gate rotor (50), the gate supports (57) of the support member (55) are arranged on the gates (51) on a one-by-one basis. Each of the gate supports (57) supports an associated one of the gates (51) of the gate rotor (50) from the back surface (51*b*). The gate rotor (50) is fixed to the support member (55) via the fixing pin (54).

The front surface (50*a*) and back surface (50*b*) of the gate rotor (50) are flat surfaces which are substantially orthogonal to the center axis of the gate rotor (50).

<Arrangement of Gate Rotor Assembly>

As shown FIG. 2, the two gate rotor assemblies (60) are arranged in the casing (10) to be axially symmetric with respect to a rotation axis of the screw rotor (40). The rotation axis of each of the gate rotor assemblies (60) (i.e., the center axis of the support member (55)) and the rotation axis of the screw rotor (40) substantially form a right angle.

Specifically, the gate rotor assembly (60) on the left of the screw rotor (40) in FIG. 2 is arranged with the shaft (58) of the support member (55) extending upward. The gate rotor assembly (60) on the right of the screw rotor (40) shown in FIG. 2 is arranged with the shaft (58) of the support member (55) extending downward. The front surface (50*a*) of the gate rotor (50) of each gate rotor assembly (60) faces the sealing surface (21) of the casing (10) with a gap therebetween.

—Gap Adjuster Mechanism—

Figure 5:
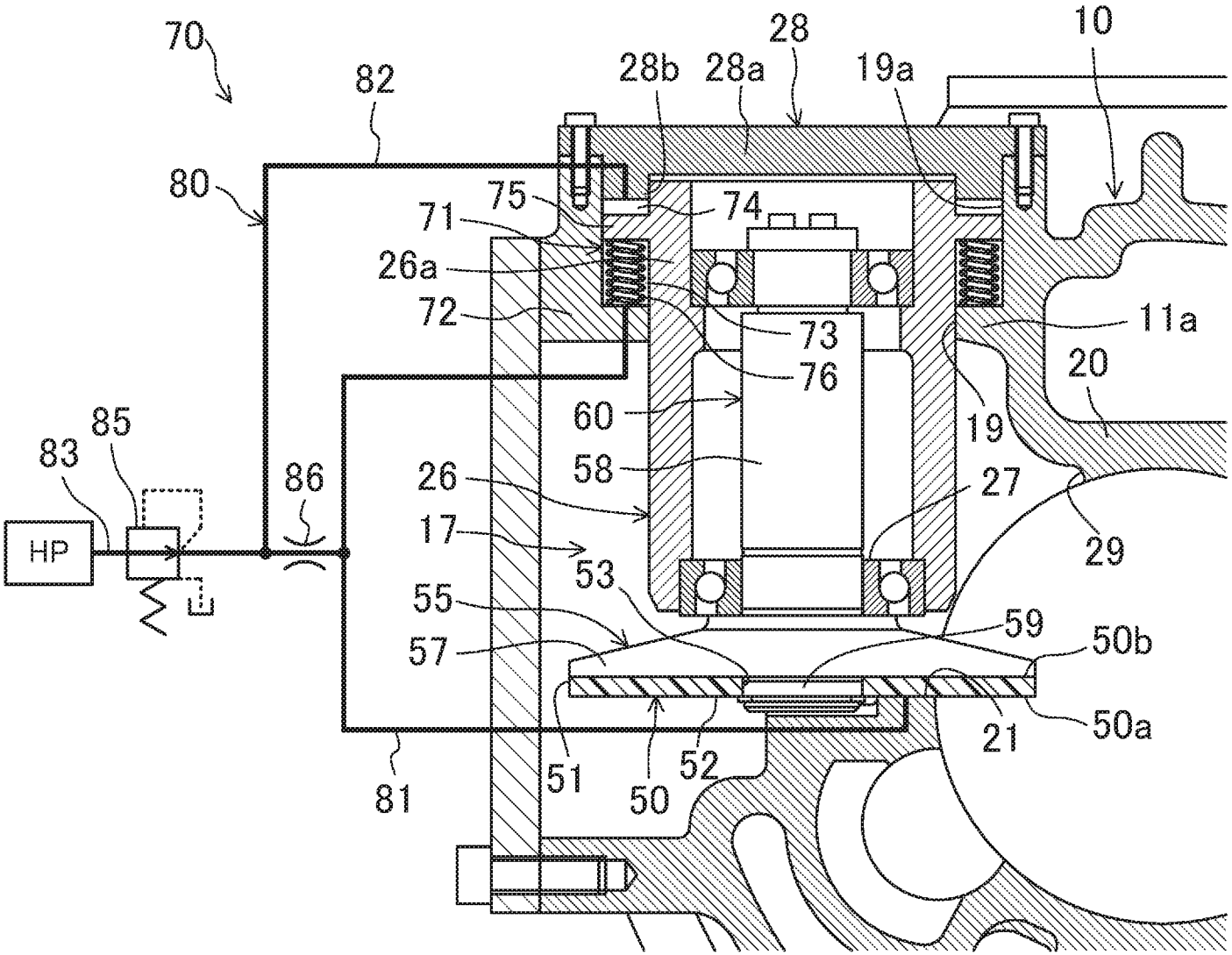
FIG. 5 is a diagram illustrating a partially enlarged view of FIG. 2.
Figure 6:
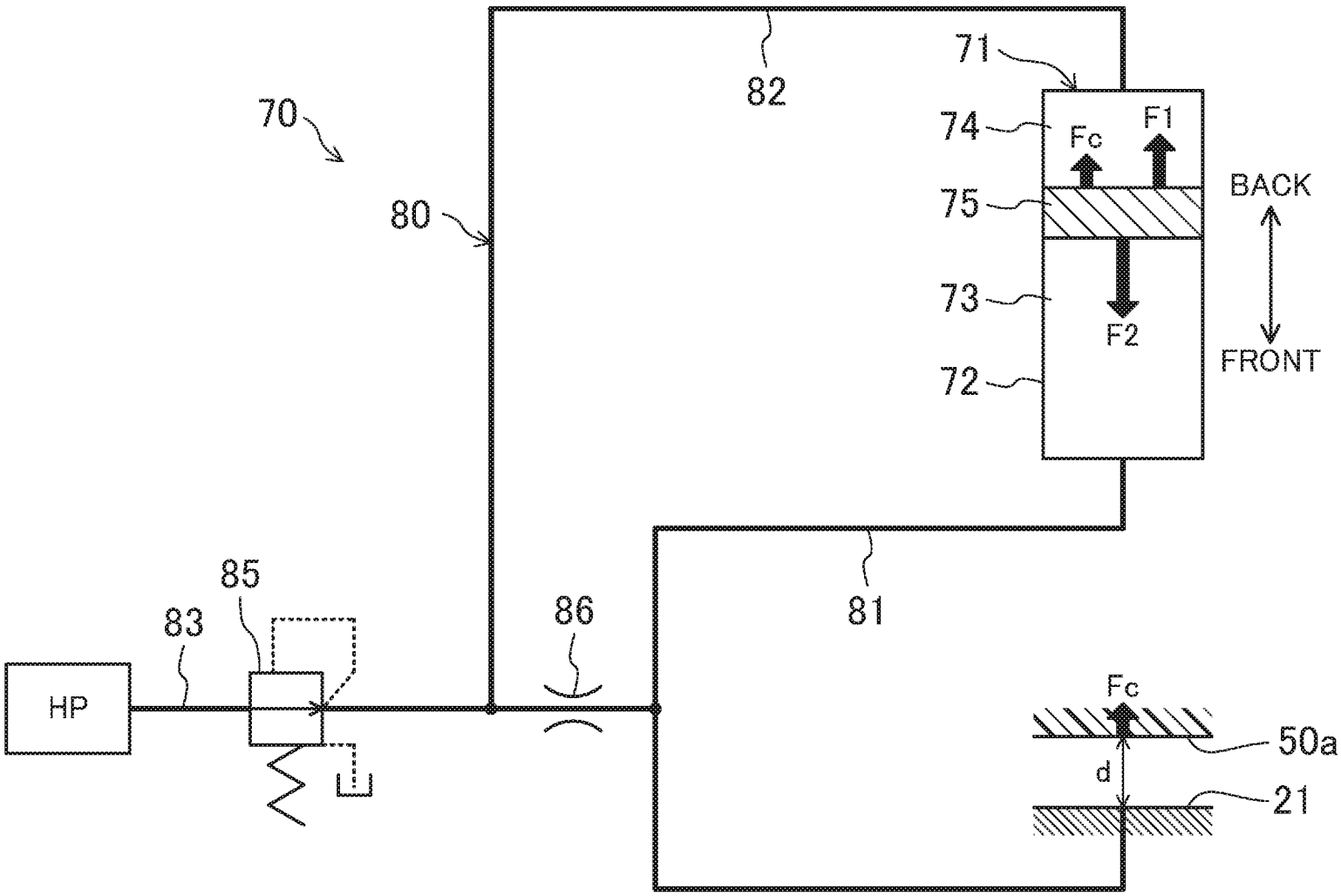
FIG. 6 is a diagram generally illustrating a configuration of a gap adjuster mechanism of the single-screw compressor according to the first embodiment.

As shown in FIGS. 5 and 6, the single-screw compressor (1) is provided with a gap adjuster mechanism (70) configured to adjust a distance d between the front surface (50*a*) of each gate rotor (50) and the sealing surface (21) of the cylindrical wall (20) to a predetermined distance D. As shown in FIG. 2, one gap adjuster mechanism (70) is provided for each of the two gate rotor assemblies (60). As shown in FIGS. 5 and 6, the two gap adjuster mechanisms (70) each include a cylinder mechanism (71) and a fluid circuit (80) for applying a fluid pressure to the cylinder mechanism (71). The predetermined distance D is set to be a distance which allows the refrigerating machine oil to form an oil film between the front surface (50*a*) of each gate rotor (50) and the sealing surface (21) of the cylindrical wall (20), and the oil film to keep the sealing between the front surface (50*a*) of each gate rotor (50) and the sealing surface (21) of the cylindrical wall (20).

<Cylinder Mechanism>

As shown in FIG. 5, the cylinder mechanism (71) includes a cylinder (72) which forms a cylinder chamber therein, and a piston (75) which partitions the cylinder chamber into a first cylinder chamber (73) and a second cylinder chamber (74).

The cylinder (72) is composed of the bearing holder (26) and the casing body (11). Assuming that the side of the bearing holder (26) toward the gate rotor (50) is the front side, and that the side opposite to the gate rotor (50) is the back side, the cylinder chamber is formed by the outer peripheral surface of a back side portion (26*a*) of the bearing holder (26) and a portion of the casing body (11) which surrounds the back side portion (26*a*) of the bearing holder (26).

Specifically, the casing body (11) is provided with an insertion hole (19) through which the bearing holder (26) is inserted. A peripheral wall (11*a*) of the casing body (11) having the insertion hole (19) is provided with a recessed groove (19*a*). The recessed move (19*a*) is formed in the entire circumference of the peripheral wall (11*a*). A portion of the peripheral wall (11*a*) which abuts against a back end portion of the bearing holder (26) holds the back end portion of the bearing holder (26) such that the bearing holder (26) is displaceable slightly (about 0.1 mm) in the axial direction of the gate rotor (50).

The insertion hole (19) of the casing body (11) is closed by the lid (28) after insertion of the bearing holder (26). The lid (28) has a lid body (28*a*) and the projecting portion (28*b*). The lid body (28*a*) is in a disc shape. The projecting portion (28*b*) has a substantially cylindrical shape and is integrated with the lid body (28*a*) so as to protrude from the inner surface of the lid body (28*a*). The projecting portion (28*b*) is formed to have a thickness which fits into the recessed groove (19*a*) of the peripheral wall (11*a*). The projecting portion (28*b*) holds the back end portion of the bearing holder (26) such that the bearing holder (26) is displaceable slightly (about 0.1 mm) in the axial direction of the gate rotor (50).

In the structure described above, the recessed groove (19*a*) is closed by the peripheral wall (11*a*) of the casing body (11), the back side portion (26*a*) of the bearing holder (26) facing the peripheral wall (11*a*), and the projecting portion (28*b*) of the lid (28) of the casing body (11), thereby forming a closed space. The closed space serves as the cylinder chamber. That is, the peripheral wall (11*a*) of the casing body (11), the back side portion (26*a*) of the bearing holder (26) facing the peripheral wall (11*a*), and the projecting portion (28*b*) of the lid (28) of the casing body (11) serve as the cylinder (72).

The piston (75) is a flat annular member projecting outward from the outer peripheral surface of the back side portion (26*a*) of the bearing holder (26), and is integrated with the bearing holder (26). The piston (75) is located in the cylinder chamber, which is formed so as to surround the back side portion (26*a*) of the bearing holder (26). The piston (75) divides the cylinder chamber into two chambers in the axial direction of the gate rotor (50). The first cylinder chamber (73) is formed in the front side of the piston (75). The second cylinder chamber (74) is formed in the back side of the piston (75). The piston (75) is displaceable in the cylinder chamber in the arrangement direction of the first cylinder chamber (73) and the second cylinder chamber (74).

Assuming that the area of a pressure surface of the piston (75) which faces the first cylinder chamber (73) and on which the pressure of the fluid in the first cylinder chamber (73) acts is S1, and that the area of a pressure surface of the piston (75) which faces the second cylinder chamber (74) and on which the pressure of the fluid in the second cylinder chamber (74) acts is S2, the piston (75) of this embodiment is configured such that the areas of the two pressure surfaces are equal to each other, that is, S1=S2.

As will be described in detail later, the piston (75) is displaced in the cylinder chamber in the arrangement direction of the first cylinder chamber (73) and the second cylinder chamber (74) in accordance with the distance d between the front surface (50*a*) of the gate rotor (50) and the sealing surface (21) of the cylindrical wall (20). The displacement of the piston (75) causes the bearing holder (26), which is integrated with the piston (75), to displace in the arrangement direction of the first cylinder chamber (73) and the second cylinder chamber (74), that is, in the axial direction of the gate rotor (50). The displacement of the bearing holder (26) also causes the gate rotor assembly (60), which is rotatably supported by the bearing holder (26), to displace in the axial direction of the gate rotor (50).

The first cylinder chamber (73) is provided with a spring (76). The spring (76) is disposed such that, when the gate rotor assembly (60) is installed, the distance d between the front surface (50*a*) of the gate rotor (50) and the sealing surface (21) of the cylindrical wall (20) is not 0 (zero), that is, the front surface (50*a*) of the gate rotor (50) does not come into contact with the sealing surface (21) of the cylindrical wall (20).

<Fluid Circuit>

As shown in FIGS. 5 and 6, the fluid circuit (80) includes a first passage (81), a second passage (82), and a high pressure fluid passage (83).

One end of the first passage (81) is open at the sealing surface (21) of the cylindrical wall (20), and the other end thereof is open at the first cylinder chamber (73). That is, the first passage (81) is provided to connect the first cylinder chamber (73) and the gap between the front surface (50*a*) of the gate rotor (50) and the sealing surface (21) of the cylindrical wall (20). The first passage (81) is a passage through which gas refrigerant or refrigerating machine oil can flow. In this embodiment, refrigerating machine oil flows through the first passage (81).

One end of the second passage (82) is open to the second cylinder chamber (74), and the other end thereof is connected to the high pressure fluid passage (83). That is, the second passage (82) is configured to connect the second cylinder chamber (74) to the high pressure fluid passage (83). The second passage (82) is a passage through which gas refrigerant or refrigerating machine oil can flow. In this embodiment, refrigerating machine oil flows through the second passage (82).

The high pressure fluid passage (83) is a passage through which gas refrigerant or refrigerating machine oil can flow. In this embodiment, the high pressure fluid passage (83) is connected to the oil reservoir chamber (18), and the refrigerating machine oil in the high pressure state stored in the oil reservoir chamber (18) flows through the high pressure fluid passage (83). The high pressure fluid passage (83) is provided with a pressure regulating valve (85). The pressure regulating valve (85) is comprised of a relief pressure-reducing valve which reduces the pressure of the fluid from the first side to the second side to adjust the pressure to a constant pressure. In this embodiment, the pressure regulating valve (85) is configured to reduce the pressure of the refrigerating machine oil which is in the high pressure state and is supplied from the oil reservoir chamber (18), to adjust the pressure to a constant high pressure (a pressure P2). The first passage (81) and the second passage (82) are connected to a downstream side of the pressure regulating valve (85) of the high pressure fluid passage (83). The first passage (81) is connected to the high pressure fluid passage (83) via an orifice (a throttle) (86).

This configuration allows the refrigerating machine oil in the high pressure state stored in the oil reservoir chamber (18) to flow into the high pressure fluid passage (83) in the fluid circuit (80). The pressure of the refrigerating machine oil that has flowed into the high pressure fluid passage (83) is adjusted to the constant pressure P2 by the pressure regulating valve (85), and the refrigerating machine oil flows into the first passage (81) and the second passage (82).

As is already mentioned, one end of the first passage (81) is open at the sealing surface (21) of the cylindrical wall (20), and the other end thereof is open at the first cylinder chamber (73). Thus, the refrigerating machine oil that has flowed into the first passage (81) from the high pressure fluid passage (83) is supplied to the first cylinder chamber (73), and also leaks into the gap between the front surface (50*a*) of the gate rotor (50) and the sealing surface (21) of the cylindrical wall (20). The amount of the refrigerating machine oil leaking into this gap varies according to the size of the gap (i.e., the distance d between the front surface (50*a*) of the gate rotor (50) and the sealing surface (21) of the cylindrical wall (20)). Specifically, a larger gap allows more refrigerating machine oil to leak, and a smaller gap allows less refrigerating machine oil to leak. When the amount of the refrigerating machine oil leaking from the first passage (81) increases, the pressure P1 in the first passage (81) (i.e., a first pressure acting on the first cylinder chamber (73)) decreases. On the other hand, when the amount of the refrigerating machine oil leaking from the first passage (81) decreases, the pressure P1 in the first passage (81) (i.e., the first pressure acting on the first cylinder chamber (73)) increases.

As is already mentioned, the first passage (81) is connected to the downstream side of the pressure regulating valve (85) of the high pressure fluid passage (83) via the orifice (86). Thus, the pressure P1 in the first passage (81) does not exceed the pressure P2 set by the pressure regulating valve (85). That is, the pressure P1, which is equal to or lower than the pressure P2 set by the pressure regulating valve (85), acts on the first cylinder chamber (73).

On the other hand, the second passage (82) connects the second cylinder chamber (74) to the downstream side of the pressure regulating valve (85) of the high pressure fluid passage (83) without any pressure reducing mechanism. Thus, the refrigerating machine oil, the pressure of which has been reduced to the pressure P2 set by the pressure regulating valve (85), is supplied to the second cylinder chamber (74) via the second passage (82). That is, the second pressure P2 which acts on the second cylinder chamber (74) is the pressure P2 set by the pressure regulating valve (85). The pressure P2 set by the pressure regulating valve (85) is determined to be a pressure at which the gap adjuster mechanism (70) does not operate when the distance d between the front surface (50*a*) of the gate rotor (50) and the sealing surface (21) of the cylindrical wall (20) is an appropriate distance D.

The fluid circuit (80) having the above configurations allows the pressure P1 (i.e., the first pressure), which varies according to the increase or decrease of the distance d between the front surface (50*a*) of the gate rotor (50) and the sealing surface (21) of the cylindrical wall (20), to act on the first cylinder chamber (73) of the cylinder mechanism (71), and allows the constant pressure P2 (i.e., the second pressure) to act on the second cylinder chamber (74). When the distance d between the front surface (50*a*) of the gate rotor (50) and the sealing surface (21) of the cylindrical wall (20) increases, the amount of the refrigerating machine oil leaking from the first passage (81) increases, and the pressure P1 acting on the first cylinder chamber (73) decreases, causing an imbalance of the force acting on the piston (75) of the cylinder mechanism (71). As a result, the piston (75) is displaced toward the first cylinder chamber (73) in the cylinder chamber. The gate rotor assembly (60) is displaced accordingly to the front side in the axial direction of the gate rotor (50) (toward the compression chamber (37)). As a result, the distance d between the front surface (50*a*) of the gate rotor (50) and the sealing surface (21) of the cylindrical wall (20) is reduced.

On the other hand, when the distance d between the front surface (50*a*) of the gate rotor (50) and the sealing surface (21) of the cylindrical wall (20) decreases, the amount of the refrigerating machine oil leaking from the first passage (81) decreases, and the pressure P1 acting on the first cylinder chamber (73) increases, causing an imbalance of the force acting on the piston (75) of the cylinder mechanism (71). As a result, the piston (75) is displaced toward the second cylinder chamber (74) in the cylinder chamber. The gate rotor assembly (60) is displaced accordingly to the back side in the axial direction of the gate rotor (50). As a result, the distance d between the front surface (50*a*) of the gate rotor (50) and the sealing surface (21) of the cylindrical wall (20) is increased.

In this manner, the gap adjuster mechanism (70) displaces the gate rotor assembly (60) in the axial direction according to the distance d between the front surface (50*a*) of the gate rotor (50) and the sealing surface (21) of the cylindrical wall (20), thereby adjusting the distance d between the front surface (50*a*) of the gate rotor (50) and the sealing surface (21) of the cylindrical wall (20) to a predetermined appropriate distance D.

—Operation of Screw Compressor—

An operation of the screw compressor (I) will be described below.

When the electric motor (30) is energized, the screw rotor (40) is driven by the electric motor (30) to rotate. The gate rotor assemblies (60) are driven by the screw rotor (40) to rotate.

In the compression mechanism (35), the gate rotor assemblies (60) mesh with the screw rotor (40). When the screw rotor (40) and the gate rotor assemblies (60) rotate, the gate (51) of the gate rotor (50) relatively moves from the starting end to terminal end of an associated one of the helical grooves (41) of the screw rotor (40), which changes the volume of the compression chamber (37). As a result, in the compression mechanism (35), a suction phase in which a low pressure refrigerant is sucked into the compression chamber (37), a compression phase in which the refrigerant in the compression chamber (37) is compressed, and a discharge phase in which the compressed refrigerant is discharged from the compression chamber (37) are performed.

The low pressure gas refrigerant that has flowed from the evaporator is sucked into the low pressure space (15) in the casing (10) through the suction port (12). The refrigerant in the low pressure space (15) is sucked into the compression mechanism (35) to be compressed. The refrigerant compressed in the compression mechanism (35) flows into the high pressure space (16). Thereafter, the refrigerant passes through the oil separator (33), and is discharged outside the casing (10) through the discharge port (13). The high pressure gas refrigerant discharged from the discharge port (13) flows toward the condenser.

—Operation of Gap Adjuster Mechanism—

As shown in FIGS. 5 and 6, when the operation of the screw compressor (1) is started, the gap adjuster mechanism (70) displaces the gate rotor (50) in the axial direction according to the increase or decrease of the distance d between the front surface (50*a*) of the gate rotor (50) and the sealing surface (21) of the cylindrical wall (20), thereby adjusting the distance d to the appropriate distance D. In the gap adjuster mechanism (70), the increase or decrease of the distance d varies the pressure P1 (i.e., the first pressure) acting on the first cylinder chamber (73), hence causing the force acting on the piston (75) to vary. As a result, the piston (75) is displaced in the arrangement direction of the first cylinder chamber (73) and the second cylinder chamber (74), which causes the gate rotor assembly (60) to displace in the axial direction of the gate rotor (50). The force acting on the piston (75) is varied in this manner, thereby adjusting the distance d to the appropriate distance D. The force acting on the piston and the gap adjustment operation will be described in detail below.

<Force Acting on Piston>

When the operation of the screw compressor (1) is started, the refrigerating machine oil in the high pressure state stored in the oil reservoir chamber (18) flows into the high pressure fluid passage (83) in the fluid circuit (80). The pressure of the refrigerating machine oil that has flowed into the high pressure fluid passage (83) is adjusted to the constant pressure P2 by the pressure regulating valve (85), and the refrigerating machine oil flows into the first passage (81) and the second passage (82).

One end of the first passage (81) is open at the sealing surface (21) of the cylindrical wall (20). Thus, the refrigerating machine oil that has flowed into the first passage (81) is supplied to the first cylinder chamber (73), and also leaks to the sealing surface (21) of the cylindrical wall (20) from the one end all the time. The first passage (81) is connected to the downstream side of the pressure regulating valve (85) of the high pressure fluid passage (83) via the orifice (86).

This configuration prevents the first pressure P1 in the first passage (81) which acts on the first cylinder chamber (73) from exceeding the pressure P2 set by the pressure regulating valve (85). On the other hand, the refrigerating machine oil that has flowed into the second passage (82) is supplied to the second cylinder chamber (74) without any adjustment, and the pressure P2 set by the pressure regulating valve (85) acts on the second cylinder chamber (74).

The amount of the refrigerating machine oil leaking from the first passage (81) to the sealing surface (21) of the cylindrical wall (20) varies according to the distance d between the front surface (50*a*) of the gate rotor (50) and the sealing surface (21) of the cylindrical wall (20). Specifically, a greater distance d allows more refrigerating machine oil to leak from the first passage (81), and a shorter distance d allows less refrigerating machine oil to leak from the first passage (81). In this manner, variations in the amount of the refrigerating machine oil leaking from the first passage (81) cause the pressure P1 to vary. Specifically, a greater amount of the refrigerating machine oil leaking from the first passage (81) decreases the pressure P1, and a smaller amount of the refrigerating machine oil leaking from the first passage (81) increases the pressure P1.

In this manner, the pressure P1 in the first cylinder chamber (73) varies according to the distance d between the front surface (50*a*) of the gate rotor (50) and the sealing surface (21) of the cylindrical wall (20). On the other hand, the pressure P2 in the second cylinder chamber (74) is constant. Forces in opposite directions act on the piston (75) due to the pressure P1 in the first cylinder chamber (73) and the pressure P2 in the second cylinder chamber (74).

Specifically, as shown in FIG. 6, a force F1 (F1=P1×S1) backward in the axial direction of the gate rotor (50) (i.e., in the direction from the front surface (50*a*) to the back surface (50*b*)) acts on the piston (75) due to the pressure P1 in the first cylinder chamber (73). On the other hand, a force F2 (F2=P2×S2) forward in the axial direction of the gate rotor (50) (i.e., in the direction from the back surface (50*b*) to the front surface (50*a*)) acts on the piston (75) due to the pressure P2 in the second cylinder chamber (74).

Further, a force Fc from the pressure of the compression chamber (37) (i.e., the pressure of the refrigerant present in the compression chamber (37)) also acts on the piston (75) through the gate rotor assembly (60) and the bearing holder (26).

Specifically, in the compression mechanism (35) during the operation of the screw compressor (1), some of the gates (51) (three in this embodiment) of the gate rotor (50) enter the helical grooves (41) of the screw rotor (40) in the cylindrical wall (20) from the opening (29) formed in the cylindrical wall (20), so that the gates (51) face the compression chamber (37) in the compression phase or the discharge phase. The pressure of the refrigerant in the compression chamber (37) acts on the front surfaces of the gates (51) facing the compression chamber (37), and the pressure of the refrigerant in the low pressure space (15) acts on the back surfaces of the gates (51) facing the compression chamber (37). The force Fc backward in the axial direction (i.e., in the direction from the front surface (50*a*) to the back surface (50*b*)) acts on the gate rotor (50) due to the pressure of the refrigerant in the compression chamber (37).

As shown in FIG. 3, the gate rotor (50) is fixed to the support member (55) via the fixing pin (54). The support member (55) is rotatably supported by the bearing holder (26) via the ball bearing (27), and is fixed so as to be immovable in the axial direction of the gate rotor (50). Thus, the force Fc pushing the gate rotor (50) backward in the axial direction due to the internal pressure of the compression chamber (37) is transmitted to the support member (55), and further transmitted from the support member (55) to the bearing holder (26) via the ball bearing (27).

Since the piston (75) is integrated with the bearing holder (26), the backward force Fe in the axial direction of the gate rotor (50) transmitted to the bearing holder (26) acts on the piston (75), as well. That is, the force Fe backward in the axial direction of the gate rotor (50) (i.e., in the direction from the front surface (50*a*) to the back surface (50*b*)) acts on the piston (75) due to the pressure of the refrigerant in the compression chamber (37).

The pressure of the refrigerant in the compression chamber (37) differs among the suction phase, the compression phase, and the discharge phase. In this embodiment, as shown in FIG. 4, three gates (51) of each gate rotor (50) face the three compression chambers (37) all the time. That is, the states of which three compression chambers (37) are different from each other, i.e., the suction phase, the compression phase, and the discharge phase, respectively. Thus, unless the operating state (the high pressure and low pressure of the refrigeration cycle) of the screw compressor (1) changes, the force Fe from the internal pressure of the compression chamber (37) acting on the piston (75) does not vary greatly.

As is already mentioned, the backward force F1 due to the internal pressure of the first cylinder chamber (73), the forward force F2 due to the internal pressure of the second cylinder chamber (74), and the backward force Fc due to the pressure of the refrigerant in the compression chamber (37) act on the piston (75) (see FIG. 6). In addition to the forces F1, F2, and Fe, a force Fb due to the elastic force of the spring (76) and the self weight Fg of the gate rotor assembly (60) and the bearing holder (26) act on the piston (75). The force Fb due to the spring (76) becomes the backward force Fb in each of the two gap adjuster mechanisms (70), whereas the self weight Fg becomes the forward force Fg in one of the two gap adjuster mechanisms (70) (the one on the left in FIG. 2), and becomes the backward force Fg in the other (the one on the right in FIG. 2). In this embodiment, the force Fb and the self weight Fg are extremely small as compared to the forces F1, F2, and Fe, and do not exert influence on the operation of the piston (75) (i.e., the gap adjustment operation). The force Fb and the self weight Fg are therefore ignored in the following description of the gap adjustment operation.

—Gap Adjustment Operation—

As will be described below, the gap adjuster mechanism (70) displaces the gate rotor (50) in the axial direction according to the distance d between the front surface (50*a*) of the gate rotor (50) and the sealing surface (21) of the cylindrical wall (20), thereby adjusting the distance d to an appropriate distance D.

[In the Case Where Distance D is Appropriate Distance D]

In the case where the distance d between the front surface (50*a*) of the gate rotor (50) and the sealing surface (21) of the cylindrical wall (20) is an appropriate distance D, the gap adjuster mechanism (70) does not operate. That is, when d is equal to D (d=D), the forces acting on the piston (75) are balanced, and the piston (75) is not displaced. The bearing holder (26) and the gate rotor assembly (60) are therefore not moved. Thus, the distance d between the front surface (50*a*) of the gate rotor (50) and the sealing surface (21) of the cylindrical wall (20) is maintained at the appropriate distance D.

[In the Case Where Distance D is Smaller Than Appropriate Distance D]

During the operation of the screw compressor (1), the temperature of the gate rotor (50) increases to cause the gate rotor (50) to thermally expand, which increases the thickness of the gate rotor (50). The increase in thickness of the gate rotor (50) results in that the front surface (50*a*) of the gate rotor (50) approaches the sealing surface (21) of the cylindrical wall (20), which makes the distance d smaller than the appropriate distance D. The smaller distance d than the appropriate distance D makes the refrigerating machine oil less likely to leak from the first passage (81) of the fluid circuit (80) to the sealing surface (21) of the cylindrical wall (20), thereby reducing the leaking amount of the refrigerating machine oil. The refrigerating machine oil flows into the first passage (81) from the high pressure fluid passage (83) all the time. Thus, when the amount of the refrigerating machine oil leaking from the first passage (81) decreases, the pressure P1 acting on the first passage (81) and the first cylinder chamber (73) increases.

The pressure P1 acting on the first cylinder chamber (73) is increased in this manner, and the backward force F1 among the forces F1, F2 and Fc acting on the piston (75) increases due to the increased pressure P1. The increase in the backward force F1 from the balanced state of the forces acting on the piston (75) causes a situation where the backward force acting on the piston (75) exceeds the forward force. The piston (75) is therefore displaced backward (i.e., toward the second cylinder chamber (74)) in the front-rear direction (i.e., the axial direction of the gate rotor (50)), which causes the bearing holder (26) integrally formed with the piston (75) and the gate rotor assembly (60) supported by the bearing holder (26) to be displaced backward. That is, the gate rotor (50) is retracted (i.e., displaced backward in the axial direction). As a result, the front surface (50*a*) of the gate rotor (50) moves away from the sealing surface (21) of the cylindrical wall (20) (i.e., the distance d is increased).

The gap adjuster mechanism (70) stops operating once the distance d reaches the appropriate distance D. That is, when d is equal to D (d=D), the forces acting on the piston (75) are balanced, and the piston (75) is not displaced.

[In the Case Where Distance D is Greater Than appropriate Distance D]

In the screw compressor (1), the temperature of the gate rotor (50) may be significantly increased in an abnormal operation, and the gate rotor (50) may be thermally expanded more than expected for a normal operation. Such abnormal thermal expansion is eliminated when the abnormal state is eliminated thereafter, and the thickness of the gate rotor (50) returns to the thickness in the normal operation. That is, the thickness of the gate rotor (50) is reduced. The reduction in thickness of the gate rotor (50) results in that the front surface (50*a*) of the gate rotor (50) moves away from the sealing surface (21) of the cylindrical wall (20), which makes the distance d greater than the appropriate distance D. The greater distance d than the appropriate distance D makes the refrigerating machine oil more likely to leak from the first passage (81) of the fluid circuit (80) to the sealing surface (21) of the cylindrical wall (20), thereby increasing the leaking amount of the refrigerating machine oil. The pressure P1 acting on the first passage (81) and the first cylinder chamber (73) therefore decreases.

The pressure P1 acting on the first cylinder chamber (73) decreases in this manner, and the backward force F1 among the forces F1, F2 and Fe acting on the piston (75) decreases due to the decreased pressure P1. The decrease in the backward force F1 from the balanced state of the forces acting on the piston (75) causes a situation where the forward force acting on the piston (75) exceeds the backward force. The piston (75) is therefore displaced forward (i.e., toward the first cylinder chamber (73)) in the front-rear direction (i.e., the axial direction of the gate rotor (50)), which causes the bearing holder (26) integrally formed with the piston (75) and the gate rotor assembly (60) supported by the bearing holder (26) to be displaced forward. That is, the gate rotor (50) moves forward (i.e., displaced forward in the axial direction). As a result, the front surface (50*a*) of the gate rotor (50) approaches the sealing surface (21) of the cylindrical wall (20) (i.e., the distance d is reduced).

The gap adjuster mechanism (70) stops operating once the distance d reaches the appropriate distance D. That is, when d is equal to D (d=D), the forces acting on the piston (75) are balanced, and the piston (75) is not displaced.

[Displacement of Gate Rotor due to Internal Pressure Variations of Compression Chamber]

In the screw compressor (1), the discharge pressure (high pressure) varies depending on the operating state. The backward force Fe acting on the piston (75) varies accordingly, depending on the pressure of the refrigerant in the compression chamber (37). Even when the distance d is the appropriate distance D and the backward force F1 acting on the piston (75) is not changed by the pressure P1 in the first cylinder chamber (73), the gate rotor (50) is displaced in the case of variations of the backward force Fc acting on the piston (75) due to the internal pressure of the compression chamber (37).

On the other hand, when the backward force Fe decreases from the state where the distance d is the appropriate distance D and the forces acting on the piston (75) are balanced, the piston (75) is displaced forward (toward the first cylinder chamber (73)), and the gate rotor (50) is accordingly moved forward (i.e., displaced forward in the axial direction). As a result, the front surface (50*a*) of the gate rotor (50) approaches the seating surface (21) of the cylindrical wall (20), and the distance d is smaller than the appropriate distance D.

In this manner, even when the distance d varies in association with the changes in the operating state of the screw compressor (1), the gap adjuster mechanism (70) operates as described above to adjust the distance d to the appropriate distance D.

Advantage of First Embodiment

According to the first embodiment, the gap adjuster mechanism (70) is provided to displace the gate rotor (50) in the axial direction and thereby avoid the contact between the front surface (50*a*) of the gate rotor (50) and the sealing surface (21) of the cylindrical wall (20). Thus, even when the front surface (50*a*) of the gate rotor (50) approaches the sealing surface (21) of the cylindrical wall (20) due to the thermal expansion of the gate rotor (50), the gap adjuster mechanism (70) displaces at least one of the gate rotor (50) and the sealing surface (21) of the cylindrical wall (20) in the axial direction of the gate rotor (50), thereby avoiding the contact between the front surface (50*a*) of the gate rotor (50) and the sealing surface (21) of the cylindrical wall (20).

Specifically, in the first embodiment, the gate rotor (50) is configured to be displaceable in the axial direction, and the gap adjuster mechanism (70) is provided which displaces the gate rotor (50) in the axial direction according to the distance d between the front surface (50*a*) of the gate rotor (50) and the sealing surface (21) of the cylindrical wall (20) so as to adjust the distance d to the predetermined appropriate distance D. Thus, even when the distance d between the front surface (50*a*) of the gate rotor (50) and the sealing surface (21) of the cylindrical wall (20) is deviated from the appropriate distance D due to the thermal expansion of the gate rotor (50), the gate rotor (50) is displaced in the axial direction by the gap adjuster mechanism (70), allowing the distance d to be adjusted to the appropriate distance D. That is, the gap between the front surface (50*a*) of the gate rotor (50) and the sealing surface (21) of the cylindrical wall (20) can be maintained at an appropriate gap. It is therefore possible, during operation, to prevent a large amount of fluid from leaking out of the compression chamber (37) due to a large gap, and to prevent the occurrence of the screw lock caused by the closure of the gap.

According to the first embodiment, the gap adjuster mechanism (70) includes: the first cylinder chamber (73) on which the first pressure acts (the first pressure varies according to the increase and decrease of the distance d between the front surface (50*a*) of the gate rotor (50) and the sealing surface (21) of the cylindrical wall (20)); the second cylinder chamber (74) on which the constant second pressure acts; and the piston (75) arranged between the first and second cylinder chambers (73, 74) so as to be displaceable. In addition, the gate rotor (50) is displaceable in the axial direction in association with the displacement of the piston (75). Thus, when the distance d between the front surface (50*a*) of the gate rotor (50) and the sealing surface (21) of the cylindrical wall (20) increases or decreases, the first pressure acting on the first cylinder chamber (73) increases or decreases and the forces acting on the piston (75) are unbalanced. As a result, the piston (75) is displaced, and the gate rotor (50) is driven in association with the displacement of the piston (75). Thus, the first embodiment allows the distance d between the front surface (50*a*) of the gate rotor (50) and the sealing surface (21) of the cylindrical wall (20) to be automatically adjusted to the predetermined distance D by a simple configuration.

Furthermore, the first embodiment provides: the first passage (81) connecting the first cylinder chamber (73) and the gap between the front surface (50*a*) of the gate rotor (50) and the sealing surface (21) of the cylindrical wall (20); the high pressure fluid passage (83) through which the fluid in the high pressure state flows; and the pressure regulating valve (85) which adjusts the pressure of the fluid flowing in the high pressure fluid passage (83) to a constant high pressure, in which the first passage (81) is connected to the downstream side of the pressure regulating valve (85) of the high pressure fluid passage (83) via the throttle (86). In this configuration, the fluid in the high pressure fluid passage (83) after the pressure adjustment to the constant high pressure by the pressure regulating valve (85) is supplied to the first passage (81) through the throttle (86). The fluid that has flowed into the first passage (81) is supplied to the first cylinder chamber (73) and also leaks to the gap all the time, because the first passage (81) connects between the gap and the first cylinder chamber (73). The amount of the fluid leaking from the first passage (81) to the gap varies according to the increase or decrease in the size of the gap. In association with this variation, the first pressure acting on the first cylinder chamber (73) varies as well. Thus, according to the first embodiment, the first cylinder chamber (73) on which the first pressure (which varies according to the increase or decrease of the distance d between the front surface (50*a*) of the gate rotor (50) and the sealing surface (21) of the cylindrical wall (20)) acts can be achieved by a simple configuration. That is, the gap adjuster mechanism (70) can be easily achieved which adjusts the distance d between the front surface (50*a*) of the gate rotor (50) and the sealing surface (21) of the cylindrical wall (20) to the predetermined distance D.

The first embodiment also provides the second passage (82) connecting the second cylinder chamber (74) to the downstream side of the pressure regulating valve (85) of the high pressure fluid passage (83), and the pressure regulating valve (85) is set so that the pressure of the fluid flowing through the high pressure fluid passage be adjusted to the second pressure. According to this configuration, the second cylinder chamber (74) on which the constant second pressure acts can be achieved by a simple configuration. That is, the gap adjuster mechanism (70) can be easily achieved which adjusts the distance d between the front surface (50*a*) of the gate rotor (50) and the sealing surface (21) of the cylindrical wall (20) to the predetermined distance D.

According to the first embodiment, the bearing holder (26) which rotatably supports the support member (55) of the gate rotor (50) is configured to be displaceable in the axial direction of the gate rotor (50), and the first and second cylinder chambers (73, 74) are arranged in the axial direction of the gate rotor (50) on the outer periphery of the bearing holder (26). Moreover, the piston (75) is integrated with the bearing holder (26). This configuration allows the piston (75), the bearing holder (26) integrated with the piston (75), the support member (55) rotatably supported by the bearing holder (26), and the gate rotor (50) supported by the support member (55) from the back side, to be displaced in the axial direction of the gate rotor (50) in an integrated manner when the distance d between the front surface (50*a*) of the gate rotor (50) and the sealing surface (21) of the cylindrical wall (20) varies. As a result, the distance d between the front surface (50*a*) of the gate rotor (50) and the sealing surface (21) of the cylindrical wall (20) can be adjusted to the predetermined distance D. In this manner, the bearing holder (26) integrated with the gate rotor (50) via the support member (55) is integrated with the piston (75), and the gate rotor (50) is therefore displaced together with the support member (55) and the bearing holder (26) in association with the displacement of the cylinder (72). This configuration allows the gate rotor (50) to be easily displaced in the axial direction for the adjustment of the gap.

Second Embodiment

A second embodiment is a modified version of the first embodiment, in which the configuration of the fluid circuit (80) of the gap adjuster mechanism (70) has been partially modified in the screw compressor (1).

Figure 7:
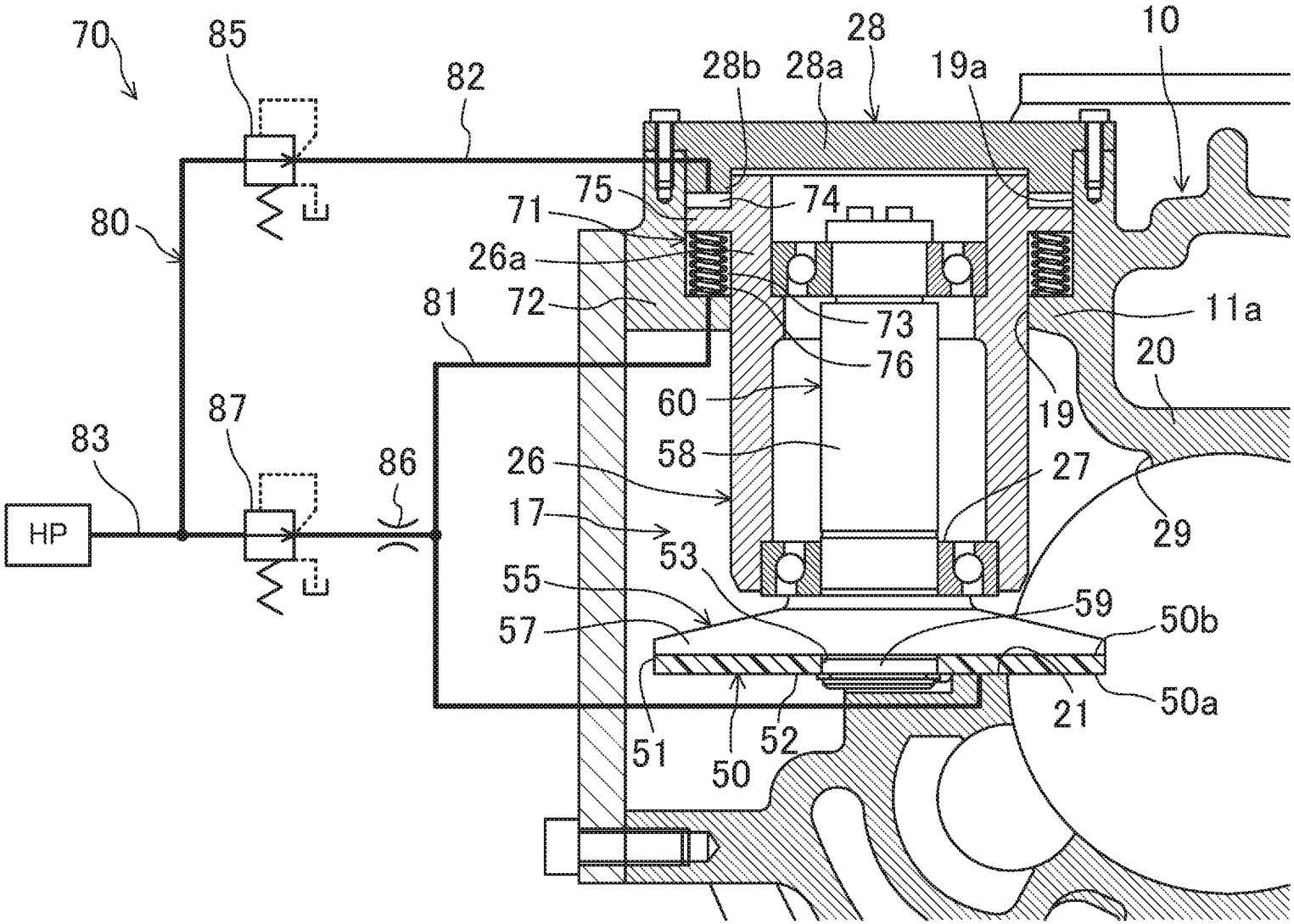
FIG. 7 is a cross-sectional view of a partially enlarged single-screw compressor according to a second embodiment.

Specifically, as shown in FIG. 7, two pressure regulating valves (85, 87) are provided in the fluid circuit (80) in the second embodiment. Similarly to the first embodiment, the pressure regulating valve (85), which is one of the two pressure regulating valves (85, 87), is configured to reduce the pressure of the refrigerating machine oil in the high pressure state from the oil reservoir chamber (18) so as to adjust the pressure to a constant high pressure (a pressure P2). In the second embodiment, the pressure regulating valve (85) is provided in the second passage (82). On the other hand, the other pressure regulating valve (a second pressure regulating valve) (87) of the two pressure regulating valves (85, 87) is intended to reduce the pressure of the refrigerating machine oil in the high pressure state from the oil reservoir chamber (18) so as to adjust the pressure to a pressure P3 different from the pressure P2. The pressure regulating valve (87) is provided in the high pressure fluid passage (83) at a position downstream of the connecting portion with the second passage (82) and upstream of the orifice (86).

According to this configuration of the second embodiment, the refrigerating machine oil in the high pressure state supplied from the oil reservoir chamber (18) to the high pressure fluid passage (83) diverges into the first passage (81) and the second passage (82), and is depressurized independently by the respective pressure regulating valves (85, 87) to be adjusted to the predetermined pressures P2 and P3.

Such a configuration of the second embodiment may have the similar advantages to those in the first embodiment. The second embodiment also provides the second passage (82) connecting the second cylinder chamber (74) to the upstream side of the pressure regulating valve (87) of the high pressure fluid passage (83), and the pressure regulating valve (85) which maintains the pressure of the fluid flowing through the second passage (82) at the second pressure. According to this configuration, the second cylinder chamber (74) on which the constant second pressure acts can be achieved by a simple configuration. That is, the gap adjuster mechanism (70) can be easily achieved which adjusts the distance d between the front surface (50*a*) of the gate rotor (50) and the sealing surface (21) of the cylindrical wall (20) to the predetermined distance D.

In addition, suppose that the screw compressor (1) is large and the self weight Fg of the gate rotor assembly (60) and the bearing holder (26) is large enough to affect the operation of the piston (75) (i.e., gap adjustment operation). In such a case, according to the second embodiment, the pressure P3 set by the pressure regulating valve (87) is set, for example, to a pressure higher than the pressure P2 set by the pressure regulating valve (85) so as to increase the backward force F1 acting on the piston (75) due to the pressure of the fluid in the first cylinder chamber (73), thereby canceling out the self weight Fg of the gate rotor assembly (60) and the bearing holder (26).

Third Embodiment

A third embodiment is a modified version of the first embodiment, in which the configuration of the cylinder mechanism (71) of the gap adjuster mechanism (70) has been partially modified in the screw compressor (1).

Figure 8:
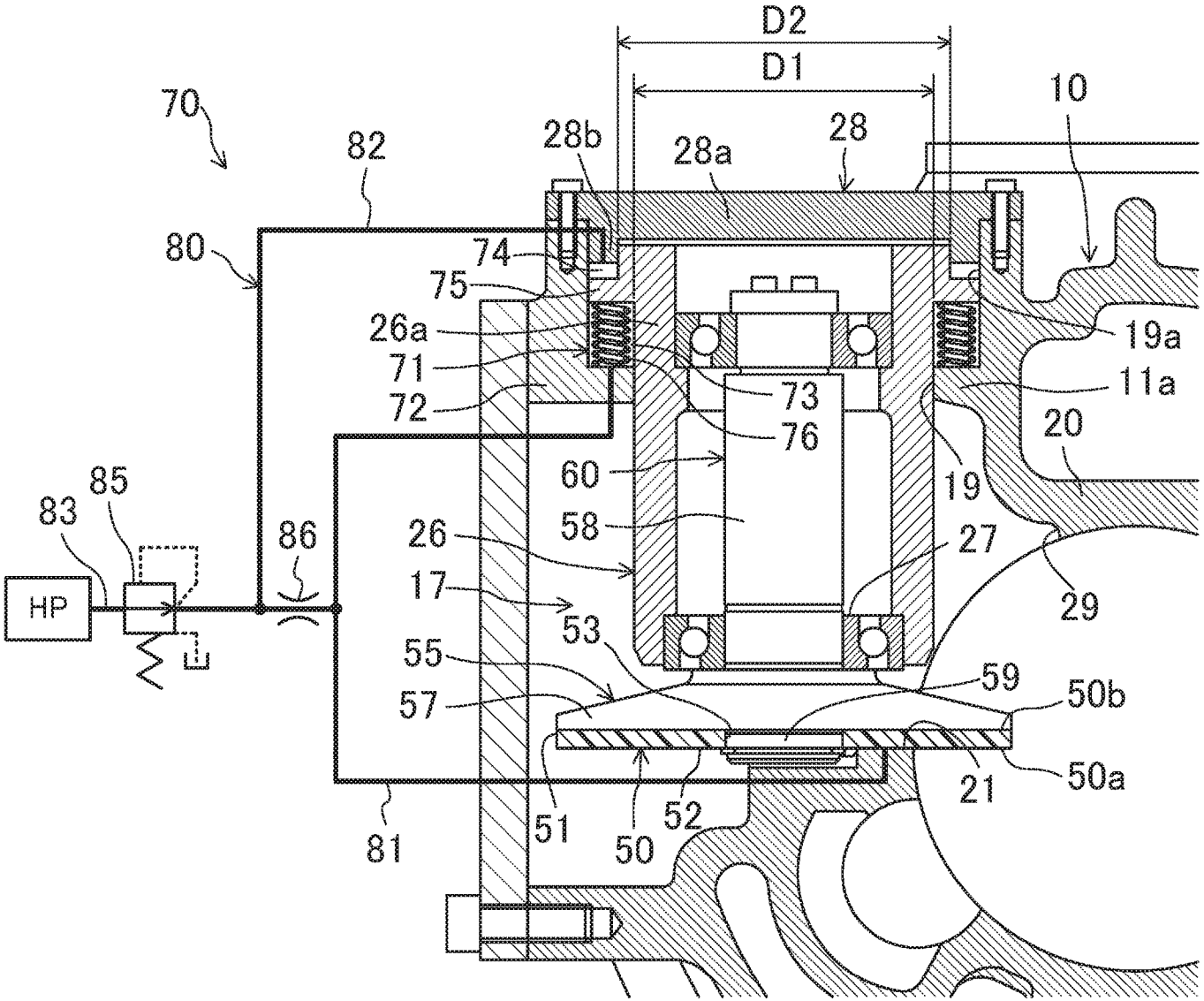
FIG. 8 is a cross-sectional view of a partially enlarged single-screw compressor according to a third embodiment.

As shown in FIG. 8, in the third embodiment, the cylinder (72) is configured such that the cross-sectional area of the second cylinder chamber (74) is smaller than the cross-sectional area of the first cylinder chamber (73). Specifically, the outer diameter D2 of a back end portion of the cylindrical bearing holder (26) facing the second cylinder chamber (74) is larger than the outer diameter D1 of a portion of the cylindrical bearing holder (26) facing the first cylinder chamber (73). Thus, in the third embodiment, the area S2 of the pressure surface of the piston (75) toward the second cylinder chamber (74) is smaller than the area S1 of the pressure surface of the piston (75) toward the first cylinder chamber (73).

Such a configuration of the third embodiment may have the similar advantages to those in the first embodiment. In addition, according to the third embodiment, even if the screw compressor (1) is large and the self weight Fg of the gate rotor assembly (60) and the bearing holder (26) is large enough to affect the operation of the piston (75) (i.e., gap adjustment operation), the forward force F2 acting on the piston (75) due to the pressure of the fluid in the second cylinder chamber (74) is smaller than the forward force F2 according to the configuration of the first embodiment, thereby canceling out the self weight Fg of the gate rotor assembly (60) and the bearing holder (26).

Fourth Embodiment

A fourth embodiment is a modified version of the first embodiment, in which the configuration of the gap adjuster mechanism (70) has been partially modified in the screw compressor (1).

Figure 9:
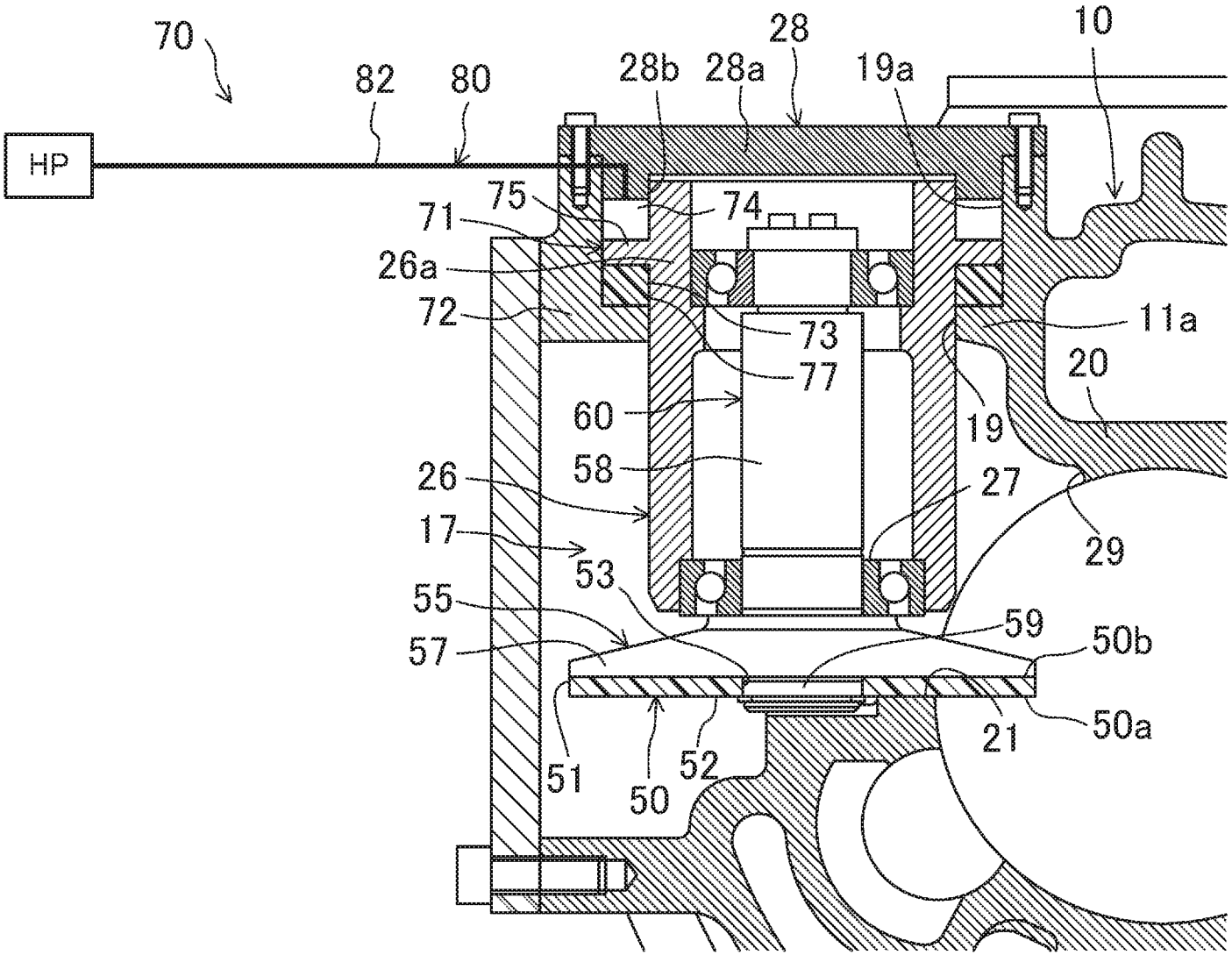
FIG. 9 is a cross-sectional view of a partially enlarged single-screw compressor according to a fourth embodiment.

As shown in FIG. 9, the fourth embodiment provides a configuration of the cylinder mechanism (71) of the gap adjuster mechanism (70) similar to the configuration in the first embodiment. However, the spring (76) provided in the first cylinder chamber (73) in the first embodiment is replaced with a thermal expansion member (77) made of a material having a higher thermal expansion coefficient than the material of the cylinder (72) is provided in the first cylinder chamber (73). In the fourth embodiment, the bearing holder (26) and the casing body (11) which constitute the cylinder (72) are made of cast iron (for example, FC250), and the thermal expansion member (77) is made of polytetrafluoroethylene (PTFE). The thermal expansion coefficient of PTFE is $10\times10^{-5}$/° C., which is about 8 times the thermal expansion coefficient of FC250 ($12\times10^{-6}$/° C.). In this embodiment, the thermal expansion member (77) has a transverse section substantially the same as the transverse section of the first cylinder chamber (73).

In the fourth embodiment, the fluid circuit (80) is comprised of only the second passage (82), one end of which is open to the second cylinder chamber (74). The other end of the second passage (82) is connected to a passage through which gas refrigerant or refrigerating machine oil in a high pressure state flows, or a space where gas refrigerant or refrigerating machine oil in a high pressure state is stored. In the fourth embodiment, the other end of the second passage (82) is connected to the oil reservoir chamber (18). This configuration of the fourth embodiment allows the refrigerating machine oil in the high pressure state stored in the oil reservoir chamber (18) to flow into the second cylinder chamber (74) through the second passage (82).

In this configuration, the gap adjuster mechanism (70) displaces the gate rotor (50) in the axial direction according to the temperature in the gate rotor chamber (17), thereby adjusting the distance d between the front surface (50*a*) of the gate rotor (50) and the sealing surface (21) of the cylindrical wall (20) to a predetermined distance D. The adjustment movement will be described in detail below.

During the operation of the screw compressor (1), the temperature of the gate rotor (50) increases to cause the gate rotor (50) to thermally expand, which increases the thickness of the gate rotor (50). In the abnormal operation, such as high differential pressure operation or low load operation which exceed the allowable operation range, the amount of the refrigerant circulating in the screw compressor (1) increases, and the temperature in the gate rotor chamber (17) significantly increases. As a result, the thermal expansion of the gate rotor (50) becomes significant, and the thickness of the gate rotor (50) significantly increases. The increase in thickness of the gate rotor (50) causes the front surface (50*a*) of the gate rotor (50) to approach the sealing surface (21) of the cylindrical wall (20), that is, causes the distance d to be smaller than the appropriate distance D.

The significant rise in temperature in the gate rotor chamber (17) causes the temperature of the thermal expansion member (77) provided in the first cylinder chamber (73) of the cylinder mechanism (71) to increase, and the thermal expansion member (77) to thermally expand and increase in thickness. The increase in thickness of the thermal expansion member (77) causes the thermal expansion member (77) to push the piston (75), which is thus displaced backward (toward the second cylinder chamber (74)) in the front-rear direction (in the axial direction of the gate rotor (50)). Such displacement of the piston (75) causes the bearing holder (26) integrally formed with the piston (75) and the gate rotor assembly (60) supported by the bearing holder (26) to be displaced backward. That is, the gate rotor (50) is retracted (i.e., displaced backward in the axial direction).

That is, the significant increase in temperature in the gate rotor chamber (17) in an abnormal operation causes the gate rotor (50) to be thermally expanded more than expected for a normal operation, which therefore causes the front surface (50*a*) of the gate rotor (50) to approach the sealing surface (21) of the cylindrical wall (20). At the same time, however, the thermal expansion member (77) thermally expands and pushes the piston (75) toward the second cylinder chamber (74), causing the retraction of the gate rotor (50) and preventing the front surface (50*a*) of each gate rotor (50) from coming into contact with the sealing surface (21) of the cylindrical wall (20). A gap is therefore ensured therebetween. Thus, such a thermal expansion member (77) is used which has a thermal expansion coefficient at which the thickness thereof increases by the length equal to the distance D when the temperature of the gate rotor chamber (17) increases to a temperature at which the gate rotor (50) thermally expands and comes into contact with the sealing surface (21) of the cylindrical wall (20). Using such a thermal expansion member (77) enables adjustment of the distance d between the front surface (50*a*) of each gate rotor (50) and the sealing surface (21) of the cylindrical wall (20) to the predetermined distance D.

When the abnormal state is eliminated after the gap adjustment operation described above, and the operation returns to the normal operating state, the temperature in the gate rotor chamber (17) decreases, which eliminates the abnormal thermal expansion of the gate rotor (50), as well. As a result, the thickness returns to the thickness in the normal operation. That is, the thickness of the gate rotor (50) is reduced. The reduced thickness of the gate rotor (50) causes the front surface (50*a*) of the gate rotor (50) to move away from the sealing surface (21) of the cylindrical wall (20), that is, causes the distance d to be larger than the appropriate distance D.

The drop in temperature in the gate rotor chamber (17) causes the temperature of the thermal expansion member (77) provided in the first cylinder chamber (73) of the cylinder mechanism (71) to decrease as well. The thermal expansion of the thermal expansion member (77) is eliminated, and the thickness of the thermal expansion member (77) is reduced. The forward force F2 acts on the piston (75) all the time due to the pressure P2 of the refrigerating machine oil in the second cylinder chamber (74). The forward force F2 pushes the piston (75) to the thermal expansion member (77). Thus, as the thickness of the thermal expansion member (77) decreases, the piston (75) is displaced forward while coming into contact with the thermal expansion member (77) due to the force F2. Such displacement of the piston (75) causes the bearing holder (26) integrally formed with the piston (75) and the gate rotor assembly (60) supported by the bearing holder (26) to be displaced forward. That is, the gate rotor (50) moves forward (i.e., displaced forward in the axial direction).

That is, the decrease in the temperature in the gate rotor chamber (17) after the elimination of the abnormal operation eliminates the thermal expansion of the gate rotor (50), which therefore causes the front surface (50*a*) of the gate rotor (50) to move away from the sealing surface (21) of the cylindrical wall (20). At the same time, however, the thermal expansion of the thermal expansion member (77) is eliminated as well, causing the piston (75) to be displaced forward. Thus, the front surface (50*a*) of each gate rotor (50) is not too far from the sealing surface (21) of the cylindrical wall (20). The distance d between the front surface (50*a*) of each gate rotor (50) and the sealing surface (21) of the cylindrical wall (20) is therefore adjusted to the predetermined distance D.

Such a configuration of the fourth embodiment may have the similar advantages to those in the first embodiment. The fourth embodiment allows for a simple configuration of the fluid circuit (80) of the gap adjuster mechanism (70).

Fifth Embodiment

A fifth embodiment is a modified version of the first embodiment, in which the configuration of the gap adjuster mechanism (70) has been modified in the screw compressor (1).

Figure 10:
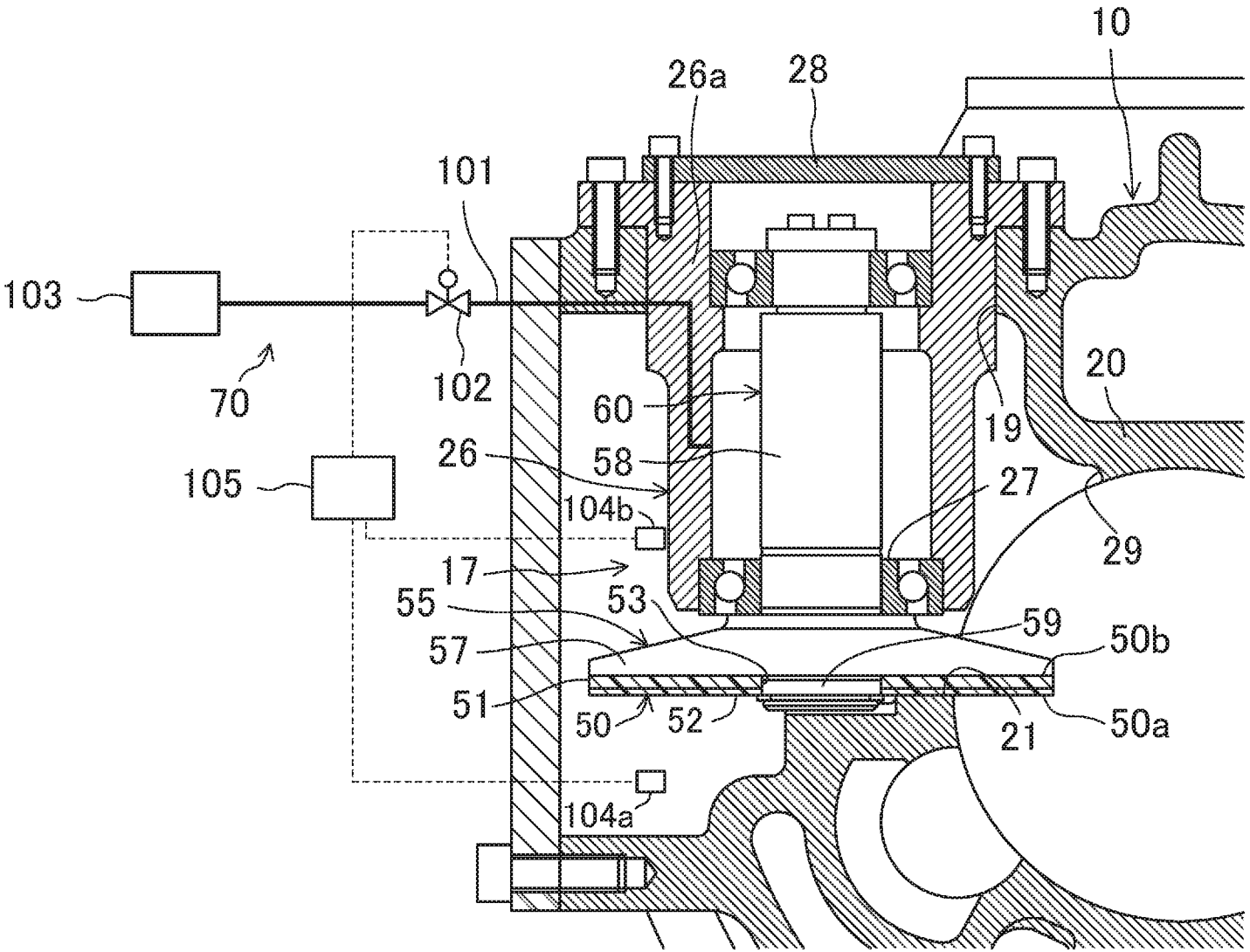
FIG. 10 is a cross-sectional view of a partially enlarged single-screw compressor according to a fifth embodiment.

As shown in FIG. 10, according to the fifth embodiment, the gap adjuster mechanism (70) includes, instead of the cylinder mechanism (71) and the fluid circuit (80), a cooling passage (101), an electromagnetic valve (102), a cooling liquid supply source (103), two temperature sensors (104*a*, 104*b*), and a controller (105). In the fifth embodiment, the bearing holder (26), which is displaceable in the axial direction of the gate rotor (50) in the first embodiment, is fixed to the casing body (11), and is immovable in the axial direction of the gate rotor (50).

The cooling passage (101) has one end connected to the cooling liquid supply source (103), and the other end that is open to the space in the bearing holder (26) (between the ball bearings (27)) so that the cooling liquid of the cooling liquid supply source (103) is supplied to the space in the bearing holder (26). In this embodiment, the cooling liquid supply source (103) is a refrigerant circuit to which the screw compressor (1) is connected. The cooling passage (101) is connected to a high pressure liquid pipe of the refrigerant circuit to lead the high pressure liquid refrigerant to the space in the bearing holder (26) as a cooling liquid.

The electromagnetic valve (102) is provided in the cooling passage (101) to open and close the cooling passage (101). A communicated state in which the cooling liquid supply source (103) communicates with the space in the bearing holder (26) and a non-communicated state in which the communication between the cooling liquid supply source (103) and the space in the bearing holder (26) is blocked are switched by opening and closing the cooling passage (101).

The cooling liquid supply source (103) supplies the cooling liquid into the space in the bearing holder (26). The cooling liquid is for cooling the bearing holder (26) and the support member (55) which is rotatably supported by the bearing holder (26) and which supports the gate rotor (50). As mentioned above, the cooling liquid supply source (103) is comprised of a refrigerant circuit to which the screw compressor (1) is connected, and is used to supply the high pressure liquid refrigerant flowing through the high pressure liquid pipe to the space in the bearing holder (26) via the cooling passage (101). The cooling liquid supply source (103) is not limited to the refrigerant circuit to which the screw compressor (1) is connected, and may also be another refrigerant circuit or a source which supplies the refrigerating machine oil at low temperature to the space in the bearing holder (26).

The temperature sensor (104*a*) is provided in the gate rotor chamber (17) to detect a temperature in the gate rotor chamber (17). In this embodiment, the temperature sensor (104*a*) is provided near the gate rotor (50). On the other hand, the temperature sensor (104*b*) is attached to the bearing holder (26) to detect a temperature of the bearing holder (26).

The controller (105) is connected to the two temperature sensors (104*a*, 104*b*) so that the detection values of the two temperature sensors (104*a*, 104*b*) are input thereto, and is also connected to the electromagnetic valve (102) to control the opening and closing of the electromagnetic valve (102). The controller (105) is configured to change the state of the electromagnetic valve (102) based on the detected values of the two temperature sensors (104*a*, 104*b*) and thereby displace the gate rotor (50) in the axial direction, so that the contact between the front surface (50*a*) of the gate rotor (50) and the sealing surface (21) of the cylindrical wall (20) is avoided.

For example, when the temperature within the gate rotor chamber (17) detected by the temperature sensor (104*a*) exceeds a predetermined high temperature, the controller (105) switches the electromagnetic valve (102) from the closed state to the open state, and thereafter controls the electromagnetic valve (102) by opening and closing the electromagnetic valve (102) so that the temperature of the bearing holder (26) detected by the temperature sensor (104*b*) becomes a predetermined low temperature.

The predetermined high temperature is a temperature within the gate rotor chamber (17) at which the distance d between the front surface (50*a*) of the gate rotor (50) and the sealing surface (21) of the cylindrical wall (20) is a predetermined short distance which is shorter than the predetermined appropriate distance D and therefore may result in contact between the front surface (50*a*) of the gate rotor (50) and the sealing surface (21) of the cylindrical wall (20). The predetermined low temperature is a temperature of the bearing holder (26) at which the predetermined appropriate distance D is secured between the front surface (50*a*) of the gate rotor (50) and the sealing surface (21) of the cylindrical wall (20) due to contraction of the bearing holder (26) and the support member (55) when the temperature within the gate rotor chamber (17) is the predetermined high temperature. The predetermined high temperature and the predetermined low temperature are determined by testing and calculation in advance, and are stored in the controller (105).

According to this configuration, the gap adjuster mechanism (70) displaces (retracts) the gate rotor (50) in the axial direction when the temperature within the gate rotor chamber (17) reaches the predetermined high temperature, thereby adjusting the gap between the front surface (50*a*) of the gate rotor (50) and the sealing surface (21) of the cylindrical wall (20) to prevent contact between the front surface (50*a*) of the gate rotor (50) and the sealing surface (21) of the cylindrical wall (20). The adjustment movement will be described in detail below.

During the operation of the screw compressor (1), the temperature of the gate rotor (50) increases to cause the gate rotor (50) to thermally expand, which increases the thickness of the gate rotor (50). In the abnormal operation, such as high differential pressure operation or low load operation which exceed the allowable operation range, the amount of the refrigerant circulating in the screw compressor (1) increases, and the temperature in the gate rotor chamber (17) significantly increases. As a result, the thermal expansion of the gate rotor (50) becomes significant, and the thickness of the gate rotor (50) significantly increases. The increase in thickness of the gate rotor (50) causes the front surface (50*a*) of the gate rotor (50) to approach the sealing surface (21) of the cylindrical wall (20), that is, causes the distance d to be smaller than the appropriate distance D.

The controller (105) changes the closed state of the electromagnetic valve (102) to the open state when the temperature within the gate rotor chamber (17) detected by the temperature sensor (104*a*) has increased to the predetermined high temperature, at which the distance d between the front surface (50*a*) of the gate rotor (50) and the sealing surface (21) of the cylindrical wall (20) is the predetermined short distance which may result in contact between the front surface (50*a*) of the gate rotor (50) and the sealing surface (21) of the cylindrical wall (20). When the electromagnetic valve (102) is open, the cooling liquid supply source (103) communicates with the space in the bearing holder (26), and the cooling liquid is supplied from the cooling liquid supply source (103) to the space in the bearing holder (26). In this embodiment, the high pressure liquid refrigerant in the refrigerant circuit is supplied as the cooling liquid. The space in the bearing holder (26) is in the gate rotor chamber (17) which communicates with the low pressure space (15), and therefore has the same pressure as the pressure in the low pressure space (15). The bearing holder (26) and the support member (55) are cooled when the high pressure liquid refrigerant supplied to the space in the bearing holder (26) evaporates. The bearing holder (26) and the support member (55) are made of cast iron (for example, FC250). The bearing holder (26) and the support member (55), the temperatures of which have been increased in the abnormal operation, are cooled by the high pressure liquid refrigerant, and contract.

The controller (105) controls the electromagnetic valve (102) by opening and closing the electromagnetic valve (102) so that the temperature of the bearing holder (26) detected by the temperature sensor (104*b*) becomes the predetermined low temperature. Specifically, the controller (105) switches the state of the electromagnetic valve (102) from the open state to the closed state when the temperature of the bearing holder (26) is lower than the predetermined low temperature, and switches the state of the electromagnetic valve (102) from the closed state to the open state when the temperature of the bearing holder (26) exceeds the predetermined low temperature again. Control of the temperature of the bearing holder (26) to the predetermined temperature in this manner allows the bearing holder (26) and the support member (55) to contract by a predetermined amount, and the gate rotor (50) supported by the support member (55) which is rotatably supported by the bearing holder (26) to be retracted by a predetermined amount.

In this manner, even when in an abnormal operation the gate rotor (50) is thermally expanded more than expected for a normal operation, and the front surface (50*a*) of the gate rotor (50) is caused to approach the sealing surface (21) of the cylindrical wall (20), the cooling liquid is supplied to the space in the bearing holder (26) to cool and cause contractions of the bearing holder (26) and the support member (55), causing the retraction of the gate rotor (50). This configuration prevents the front surface (50*a*) of each gate rotor (50) from coming into contact with the sealing surface (21) of the cylindrical wall (20). A gap is therefore ensured therebetween.

When the abnormal state is eliminated and the temperature within the gate rotor chamber (17) detected by the temperature sensor (104*a*) is lower than the predetermined high temperature, the abnormal thermal expansion of the gate rotor (50) is eliminated as well. As a result, the thickness returns to the thickness in the normal operation. The front surface (50*a*) of the gate rotor (50) is thus caused to move away from the sealing surface (21) of the cylindrical wall (20).

In this situation where the temperature within the gate rotor chamber (17) is lower than the predetermined high temperature, the controller (105) stops controlling the opening and closing of the electromagnetic valve (102) based on the value detected by the temperature sensor (104*b*) (i.e., the temperature of the bearing holder (26)). That is, the electromagnetic valve (102) is not opened, but is maintained closed, even in the state in which the temperature of the bearing holder (26) is higher than the predetermined low temperature. As a result, the temperatures of the bearing holder (26) and the support member (55) are increased, and the contraction of the bearing holder (26) and the support member (55) is eliminated (i.e., the bearing holder (26) and the support member (55) extend in the axial direction of the gate rotor (50)). Thus, the front surface (50*a*) of each gate rotor (50) is not too far from the sealing surface (21) of the cylindrical wall (20). The distance d between the front surface (50*a*) and the sealing surface (21) is therefore adjusted to the predetermined distance D.

Such a configuration of the fifth embodiment may have the similar advantages to those in the first embodiment. According to the fifth embodiment, when the front surface (50*a*) of the gate rotor (50) approaches the sealing surface (21) of the cylindrical wall (20) due to the thermal expansion of the gate rotor (50), the controller (105) of the gap adjuster mechanism (70) displaces the gate rotor (50) in the axial direction, based on the temperature of the gate rotor chamber (17) detected by the temperature sensor (41*a*) and the temperature of the bearing holder (26) detected by the temperature sensor (41*b*), thereby automatically avoiding the contact between the front surface (50*a*) of the gate rotor (50) and the sealing surface (21) of the cylindrical wall (20). The detected values of the temperatures are physical quantities correlating to the distance between the front surface (50*a*) of the gate rotor (50) and the sealing surface (21) of the cylindrical wall (20).

Sixth Embodiment

A sixth embodiment is a modified version of the first embodiment, in which the configuration of the gap adjuster mechanism (70) has been modified in the screw compressor (1).

Figure 11:
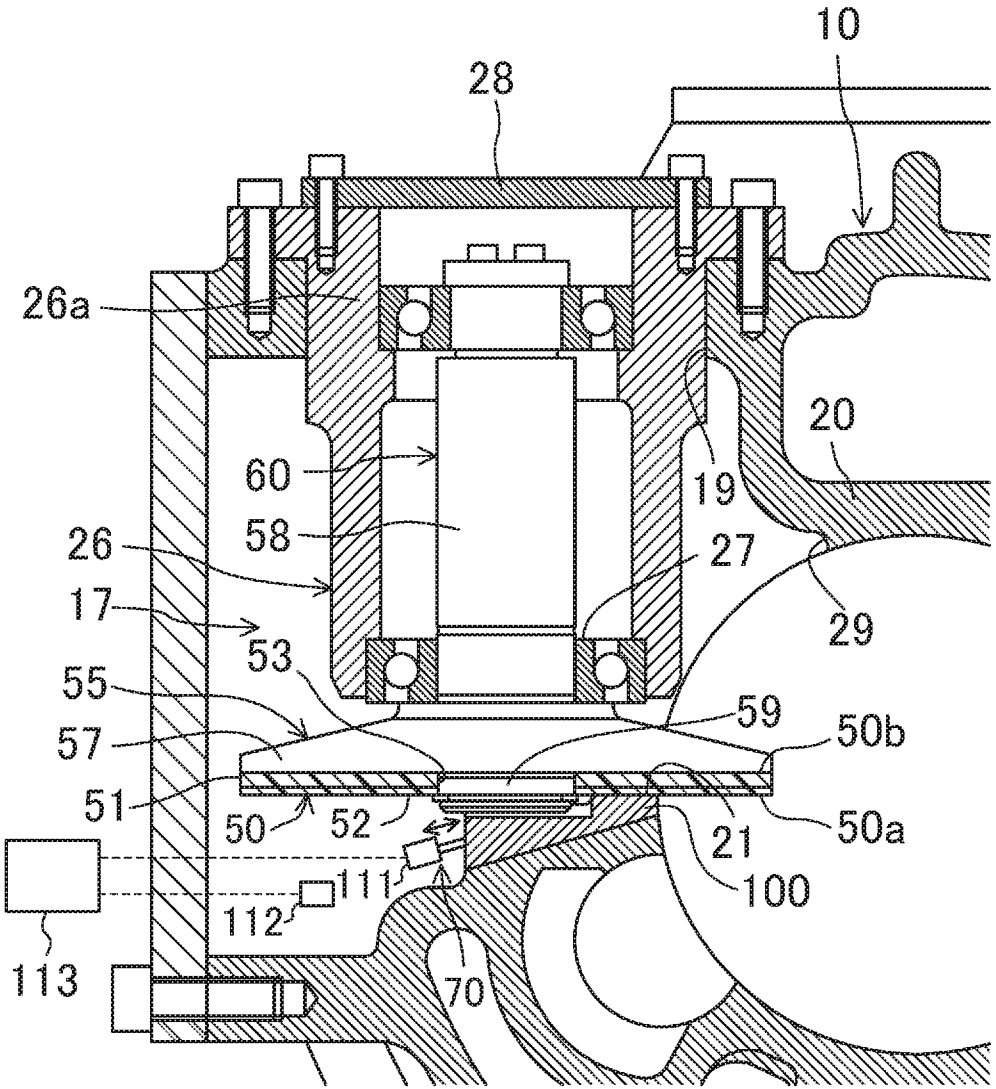
FIG. 11 is a cross-sectional view of a partially enlarged single-screw compressor according to a sixth embodiment.

As shown in FIG. 11, according to the sixth embodiment, the gap adjuster mechanism (70) includes, instead of the cylinder mechanism (71) and the fluid circuit (80), a displacement member (100), a driving mechanism (111), a temperature sensor (112), and a controller (113). In the sixth embodiment, the bearing holder (26), which is displaceable in the axial direction of the gate rotor (50) in the first embodiment, is fixed to the casing body (11), and is immovable in the axial direction of the gate rotor (50).

The displacement member (100) is an independent member which constitutes part of the cylindrical wall (20), including the sealing surface (21) of the cylindrical wall (20), which faces the gate rotor (50). The displacement member (100) has an inclined surface on the side opposite to the sealing surface (21). The inclined surface is angled with respect to a plane parallel to the sealing surface (21), and is further away from the gate rotor (50) with an increasing distance from the screw rotor (40). The inner peripheral surface of the displacement member (100) constitutes part of the inner peripheral surface of the cylindrical wall (20). The outer peripheral surface of the displacement member (100) constitutes part of the outer peripheral surface of the cylindrical wall (20).

The displace member (100) having the above configuration is displaceable in the inclined direction (i.e., the direction of the arrows in FIG. 11) along an inclined surface of the body of the cylindrical wall (i.e., the portion other than the displacement member (100) of the cylindrical wall (20)) facing the inclined surface of the displacement member (100) on the side opposite to the sealing surface (21). Displacement of the displacement member 100 in the inclined direction (i.e., the direction of the arrows in FIG. 11) along the inclined surface of the body of the cylindrical wall causes the displacement of the position of the sealing surface (21) in the axial direction of the gate rotor (50). Specifically, the displacement of the displacement member (100) in the direction away from the screw rotor (40) along the inclined surface of the body of the cylindrical wall causes forward displacement of the sealing surface (21) in the axial direction of the gate rotor (50). In other words, the sealing surface (21) is displaced in the direction away from the gate rotor (50). On the other hand, the displacement of the displacement member (100) in the direction toward the screw rotor (40) along the inclined surface of the body of the cylindrical wall causes backward displacement of the sealing surface (21) in the axial direction of the gate rotor (50). In other words, the sealing surface (21) is displaced in the direction toward the gate rotor (50).

The driving mechanism (111) is connected to the displacement member (100) and is intended to displace the displacement member (100) by pushing and pulling the displacement member (100) in the inclined direction (i.e., the direction of the arrows in FIG. 11) along the inclined surface of the body of the cylindrical wall. The driving mechanism (111) may be comprised, for example, of a stepping motor and a ball screw. The driving mechanism (111) may be any mechanism as long as the mechanism can displace the displacement member (100) in the inclined direction along the inclined surface of the body of the cylindrical wall.

The temperature sensor (112) is provided in the gate rotor chamber (17) to detect a temperature in the gate rotor chamber (17). In this embodiment, the temperature sensor (112) is provided near the gate rotor (50).

The controller (113) is connected to the temperature sensor (112) so that the detection value of the temperature sensor (112) is input thereto, and is also connected to the driving mechanism (111) to control the operation of the driving mechanism (111). The controller (113) is configured to control the operation of the driving mechanism (111), based on the detected value of the temperature sensor (112), such that the displacement member (100) is displaced to a position at which the distance d between the front surface (50*a*) of the gate rotor (50) and the sealing surface (21) of the cylindrical wall (20) is set to a predetermined appropriate distance D.

Specifically, the controller (113) stores positional information about the positions of the displacement member (100) where the distance d is the predetermined distance D, according to various temperatures in the gate rotor chamber (17). The controller (113) calculates the position of the displacement member (100) where the distance d is the predetermined distance D, based on the temperature in the gate rotor chamber (17) detected by the temperature sensor (112) and the information about the positional information, and controls the operation of the driving mechanism (111) so that the displacement member (100) is displaced to that position. The positional information about the positions of the displacement member (100) where the distance d is the predetermined distance D according to various temperatures in the gate rotor chamber (17) is obtainable from the correlation between the temperature in the gate rotor chamber (17) and the thermal expansion amount of the gate rotor (50). The correlation is obtained in advance through testing or calculation.

In this configuration, the gap adjuster mechanism (70) displaces the displacement member (100) (i.e., displaces the sealing surface (21)) according to the temperature in the gate rotor chamber (17), thereby adjusting the distance d between the front surface (50*a*) of the gate rotor (50) and the sealing surface (21) of the cylindrical wall (20) to the predetermined distance D. The adjustment movement will be described in detail below.

During the operation of the screw compressor (1), the temperature of the gate rotor (50) increases to cause the gate rotor (50) to thermally expand, which increases the thickness of the gate rotor (50). In the abnormal operation, such as high differential pressure operation or low load operation which exceed the allowable operation range, the amount of the refrigerant circulating in the screw compressor (1) increases, and the temperature in the gate rotor chamber (17) significantly increases. As a result, the thermal expansion of the gate rotor (50) becomes significant, and the thickness of the gate rotor (50) significantly increases. The increase in thickness of the gate rotor (50) causes the front surface (50*a*) of the gate rotor (50) to approach the sealing surface (21) of the cylindrical wall (20), that is, causes the distance d to be smaller than the appropriate distance D.

However, the controller (113) displaces the displacement member (100) to a position according to the temperature in the gate rotor chamber (17) detected by the temperature sensor (112), so that the sealing surface (21) is displaced in the direction away from the gate rotor (50). Thus, the front surface (50*a*) of each gate rotor (50) does not come into contact with the sealing surface (21) of the cylindrical wall (20). The distance d between the front surface (50*a*) and the sealing surface (21) is therefore adjusted to the appropriate distance D.

When the abnormal state is eliminated after the gap adjustment operation described above, and the operation returns to the normal operating state, the temperature in the gate rotor chamber (17) decreases, which eliminates the abnormal thermal expansion of the gate rotor (50), as well. As a result, the thickness returns to the thickness in the normal operation. That is, the thickness of the gate rotor (50) is reduced. The reduced thickness of the gate rotor (50) causes the front surface (50*a*) of the gate rotor (50) to move away from the sealing surface (21) of the cylindrical wall (20), that is, causes the distance d to be larger than the appropriate distance D.

However, the controller (113) displaces the displacement member (100) to a position according to the temperature in the gate rotor chamber (17) detected by the temperature sensor (112), so that the sealing surface (21) is displaced in the direction toward the gate rotor (50). Thus, the front surface (50*a*) of each gate rotor (50) is not too far from the sealing surface (21) of the cylindrical wall (20). The distance d between the front surface (50*a*) and the sealing surface (21) is therefore adjusted to the predetermined distance D.

Such a configuration of the sixth embodiment may have the similar advantages to those in the first embodiment. According to the sixth embodiment, when the front surface (50*a*) of the gate rotor (50) approaches the sealing surface (21) of the cylindrical wall (20) due to the thermal expansion of the gate rotor (50), the controller (113) of the gap adjuster mechanism (70) displaces the sealing surface (21) of the cylindrical wall (20) in the axial direction of the gate rotor (50), based on the temperature of the gate rotor chamber (17) detected by the temperature sensor (112), thereby automatically avoiding the contact between the front surface (50*a*) of the gate rotor (50) and the sealing surface (21) of the cylindrical wall (20). The detected value of the temperature is a physical quantity correlating to the distance between the front surface (50*a*) of the gate rotor (50) and the sealing surface (21) of the cylindrical wall (20).

Seventh Embodiment

A seventh embodiment is a modified version of the first embodiment, in which the configuration of the gap adjuster mechanism (70) has been modified in the screw compressor (1).

Figure 12:
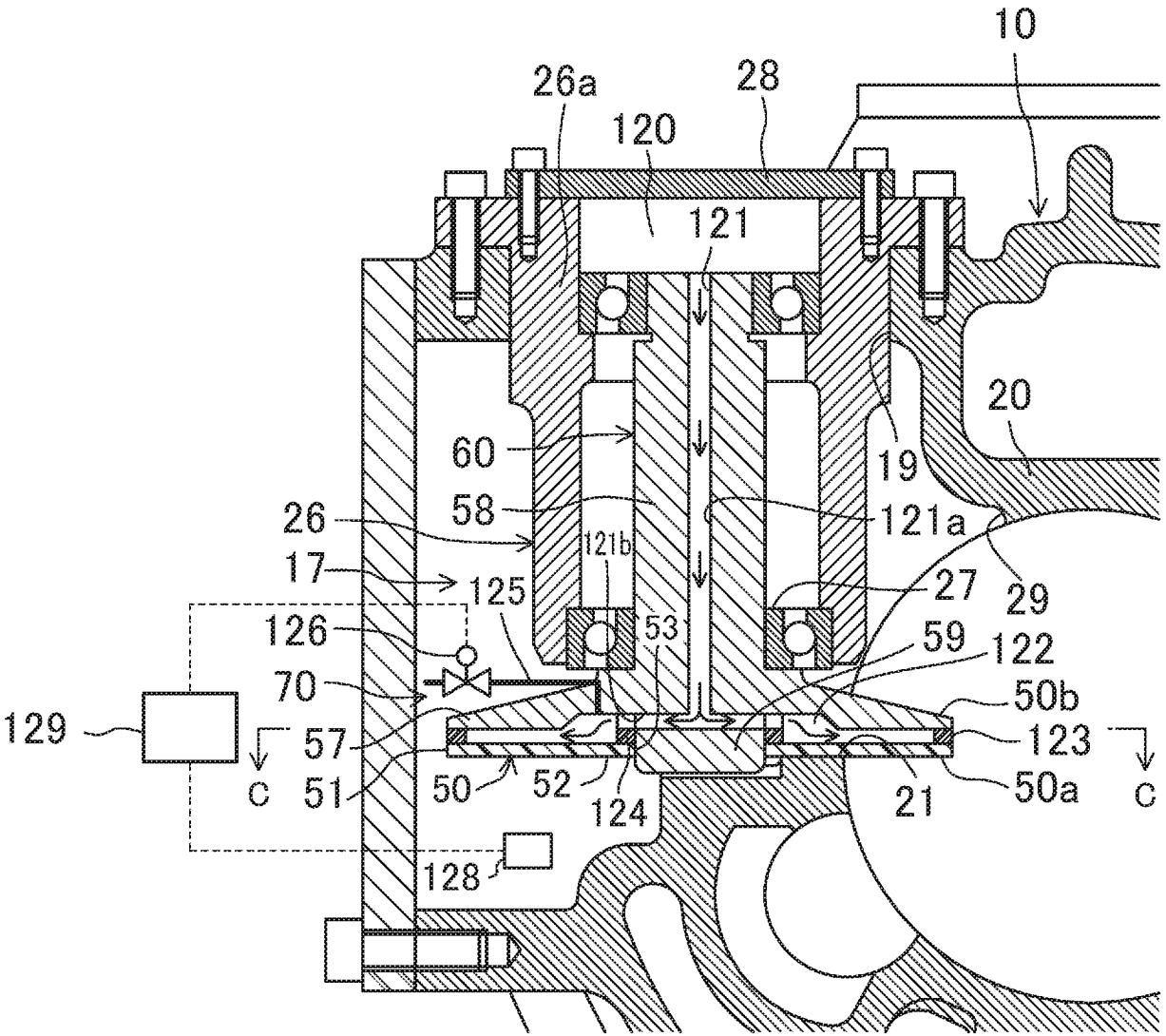
FIG. 12 is a cross-sectional view of a partially enlarged single-screw compressor according to a seventh embodiment.
Figure 13:
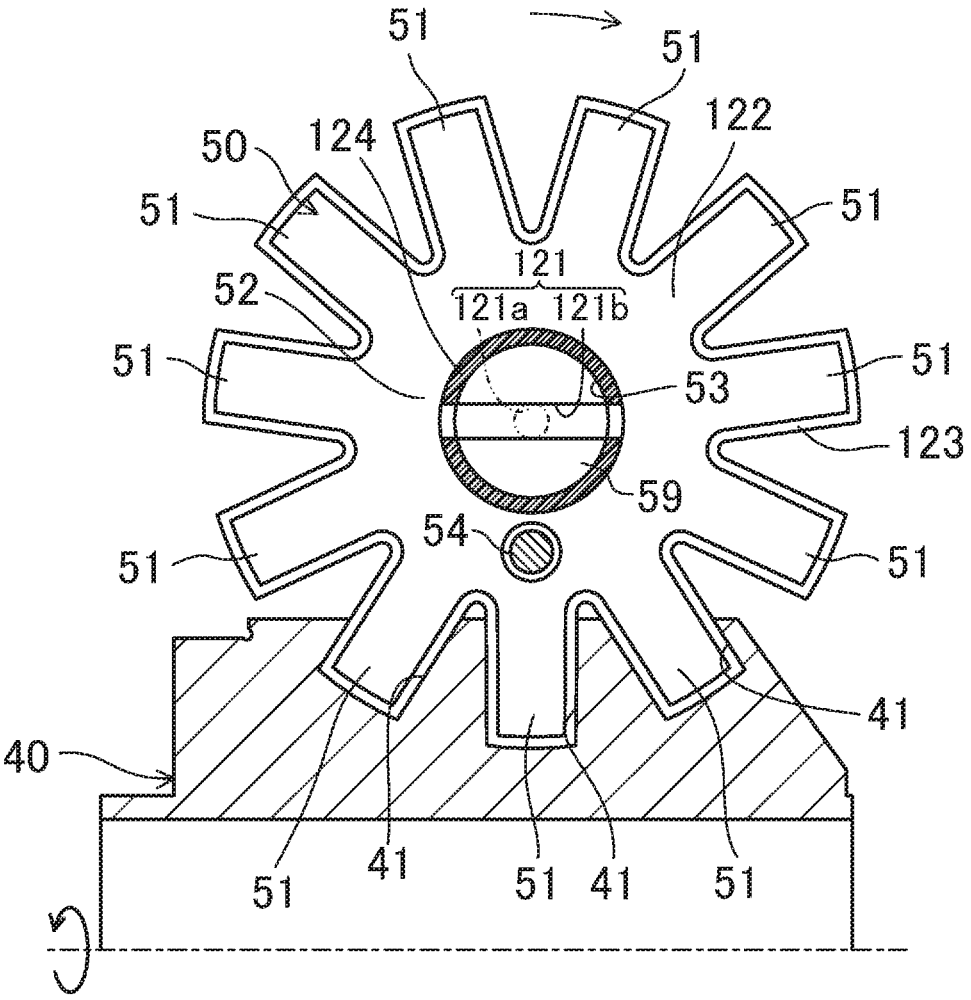
FIG. 13 is a cross-sectional view taken along line C-C in FIG. 12, illustrating the screw rotor and one of the gate rotor assemblies.

As shown in FIGS. 12 and 13, according to the seventh embodiment, the gap adjuster mechanism (70) includes, instead of the cylinder mechanism (71) and the fluid circuit (80), a back pressure mechanism and a back pressure adjuster. In the seventh embodiment, the bearing holder (26), which is displaceable in the axial direction of the gate rotor (50) in the first embodiment, is fixed to the casing body (11), and is immovable in the axial direction of the gate rotor (50).

The back pressure mechanism has an oil sump (120), an in-shaft communication passage (121), and a back pressure space (122), and applies a pressure (back pressure) forward in the axial direction to the hack surface of the gate rotor (50).

The oil sump (120) is formed behind the ball bearing (27) in the bearing holder (26), and refrigerating machine oil for supplying to the ball bearing (27) is supplied to, and stored in, the oil sump (120). The oil sump (120) communicates with the oil reservoir chamber (18) formed in the high pressure space (16) through a passage not shown. The oil sump (120) stores the high pressure refrigerating machine oil supplied from the oil reservoir chamber (18) through the communication passage not shown, and the refrigerating machine oil reaches a sliding portion of the ball bearing (27) to lubricate the sliding portion.

The in-shaft communication passage (121) includes a longitudinal communication passage (121*a*) and two lateral communication passages (121*b*). The longitudinal communication passage (121*a*) extends straight in the axial direction to pass through the center of the shaft (58) from the front end to the back end thereof. Each of the two lateral communication passages (121*b*) extends from the back front end (the end toward the gate rotor (50)) of the longitudinal communication passage (121*a*) to the outside in a radial direction of the shaft (58), and is open at the outer peripheral surface of the shaft (58).

The back pressure space (122) is a space between the back surface of the gate rotor (50) and the front surfaces of the disk portion (56) and gate supports (57) of the support member (55), and is defined by elastic members (123, 124) fixed to the gate rotor (50). The elastic members (123, 124) are made of an elastic material that is resistant to heat and having a higher elastic modulus than that of the gate rotor (50). As shown in FIG. 13, the elastic member (123) borders the outer rim of the eleven gates (51) on the back surface of the gate rotor (50). On the other hand, the elastic member (124) surrounds the outer peripheral surface of a portion where the shaft (58) of the support member (55) and the center protrusion (59) are continuous to each other at the back surface of the gate rotor (50), except for the opening portions of the two lateral communication passages (121*b*). The elastic members (123, 124) are made of an elastic material which is contracted by a backward pressing force acting in the axial direction on the front surface (50*a*) of the gate rotor (50) by the refrigerating machine oil in the high pressure state for sealing the gap between the front surface (50*a*) of the gate rotor (50) and the sealing surface (21) of the cylindrical wall (20).

This configuration allows the refrigerating machine oil in the high pressure state stored in the oil sump (120) to be supplied to the hack pressure space (122) through the in-shaft communication passage (121). Thus, the hack surface of the gate rotor (50) is pressed forward in the axial direction by the high pressure refrigerating machine oil in the back pressure space (122) (i.e., the back pressure is applied).

The back pressure adjuster includes a discharge passage (125), an electromagnetic valve (126), a temperature sensor (128), and a controller (129), and adjusts the back pressure acting on the back surface of the gate rotor (50) by the back pressure mechanism according to a temperature in the gate rotor chamber (17).

The discharge passage (125) is a passage having one end opening to the oil sump (120) of the back pressure mechanism and the other end opening to the gate rotor chamber (17).

The electromagnetic valve (126) is provided in the discharge passage (125) to open and close the discharge passage (125). A communicated state in which the oil sump (120) communicates with the gate rotor chamber (17) and a non-communicated state in which the communication between the oil sump (120) and the gate rotor chamber (17) is blocked are switched by opening and closing the discharge passage (125).

The temperature sensor (128) is provided in the gate rotor chamber (17) to detect a temperature in the gate rotor chamber (17). In this embodiment, the temperature sensor (128) is provided near the gate rotor (50).

The controller (129) is connected to the temperature sensor (128) so that a detection value of the temperature sensor (128) is input thereto, and is also connected to the electromagnetic valve (126) to control the opening and closing of the electromagnetic valve (126). The controller (129) is configured to change the state of the electromagnetic valve (126) based on the detected value of the temperature sensor (128) and thereby displace the gate rotor (50) in the axial direction, so that the contact between the front surface (50*a*) of the gate rotor (50) and the sealing surface (21) of the cylindrical wall (20) is avoided.

For example, when the temperature within the gate rotor chamber (17) detected by the temperature sensor (128) exceeds a predetermined high temperature, the controller (129) switches the electromagnetic valve (126) from the closed state to the open state. In contrast, when the temperature within the gate rotor chamber (17) detected by the temperature sensor (128) is lower than the predetermined high temperature, the controller (129) switches the electromagnetic valve (126) from the open state to the closed state.

The predetermined high temperature is a temperature within the gate rotor chamber (17) at which temperature the distance d between the front surface (50*a*) of the gate rotor (50) and the sealing surface (21) of the cylindrical wall (20) is a predetermined short distance which is shorter than the predetermined appropriate distance D and therefore may result in contact between the front surface (50*a*) of the gate rotor (50) and the sealing surface (21) of the cylindrical wall (20).

According to this configuration, the gap adjuster mechanism (70) displaces (retracts) the gate rotor (50) in the axial direction when the temperature within the gate rotor chamber (17) reaches the predetermined high temperature, thereby adjusting the gap between the front surface (50*a*) of the gate rotor (50) and the sealing surface (21) of the cylindrical wall (20) to prevent contact between the front surface (50*a*) of the gate rotor (50) and the sealing surface (21) of the cylindrical wall (20). The adjustment movement will be described in detail below.

During the operation of the screw compressor (1), the temperature of the gate rotor (50) increases to cause the gate rotor (50) to thermally expand, which increases the thickness of the gate rotor (50). In the abnormal operation, such as high differential pressure operation or low load operation which exceed the allowable operation range, the amount of the refrigerant circulating in the screw compressor (1) increases, and the temperature in the gate rotor chamber (17) significantly increases. As a result, the thermal expansion of the gate rotor (50) becomes significant, and the thickness of the gate rotor (50) significantly increases. The increase in thickness of the gate rotor (50) causes the front surface (50*a*) of the gate rotor (50) to approach the sealing surface (21) of the cylindrical wall (20), that is, causes the distance d to be smaller than the appropriate distance D.

The controller (129) changes the closed state of the electromagnetic valve (126) to the open state when the temperature within the gate rotor chamber (17) detected by the temperature sensor (128) has increased to the predetermined high temperature, at which the distance d between the front surface (50*a*) of the gate rotor (50) and the sealing surface (21) of the cylindrical wall (20) is the predetermined short distance which may result in contact between the front surface (50*a*) of the gate rotor (50) and the sealing surface (21) of the cylindrical wall (20). When the electromagnetic valve (126) is open, the oil sump (120) communicates with the gate rotor chamber (17), and the high pressure refrigerating machine oil in the oil sump (120) is discharged to the gate rotor chamber (17). Thus, the back pressure is no longer applied to the back surface of the gate rotor (50) by the high pressure refrigerating machine oil.

The gap between the front surface (50*a*) of the gate rotor (50) and the sealing surface (21) of the cylindrical wall (20) is sealed by an oil film formed by the high pressure refrigerating machine oil supplied to the sliding portion of the screw rotor (40), part of which refrigerating machine oil flows into the gap to form the oil film. Due to this refrigerating machine oil sealing the gap, a backward pressing force in the axial direction is applied to the front surface (50*a*) of the gate rotor (50). In this configuration, when the electromagnetic valve (126) is opened and the back pressure is no longer applied to the back surface of the gate rotor (50) by the high pressure refrigerating machine oil, the axial backward pressing force due to the high pressure refrigerating machine oil sealing the gap between the front surface (50*a*) of the gate rotor (50) and the sealing surface (21) of the cylindrical wall (20), and an axial forward force due to the elastic members (123, 124) act on the gate rotor (50). As already mentioned, the elastic members (123, 124) are made of an elastic material which is contracted by a backward pressing force acting in the axial direction on the front surface (50*a*) of the gate rotor (50) by the high pressure refrigerating machine oil. Thus, the elastic members (123, 124) are contracted by the backward pressing force acting in the axial direction on the front surface (50*a*) of the gate rotor (50) by the high pressure refrigerating machine oil, thereby causing the gate rotor (50) to retract backward in the axial direction.

In this manner, even when in an abnormal operation the gate rotor (50) is thermally expanded more than expected for a normal operation, and the front surface (50*a*) of the gate rotor (50) is caused to approach the sealing surface (21) of the cylindrical wall (20), the high pressure refrigerating machine oil in the back pressure space (122) is discharged so that the pressing force acting on the front surface (50*a*) of the gate rotor (50) exceeds the pressing force acting on the back surface of the gate rotor (50), causing the gate rotor (50) to retract. This configuration prevents the front surface (50*a*) of each gate rotor (50) from coming into contact with the sealing surface (21) of the cylindrical wall (20). A gap is therefore ensured therebetween.

When the abnormal state is eliminated and the temperature within the gate rotor chamber (17) detected by the temperature sensor (128) is lower than the predetermined high temperature, the abnormal thermal expansion of the gate rotor (50) is eliminated as well. As a result, the thickness returns to the thickness in the normal operation. The front surface (50*a*) of the gate rotor (50) is thus caused to move away from the sealing surface (21) of the cylindrical wall (20).

In this situation where the temperature within the gate rotor chamber (17) is lower than the predetermined high temperature, the controller (129) changes the state of the electromagnetic valve (126) from the open state to the closed state, thereby filling the back pressure space (122) again with the high pressure refrigerating machine oil. That is, the back pressure acts on the back surface of the gate rotor (50) due to the high pressure refrigerating machine oil in the back pressure space (122). As a result, the contraction of the elastic members (123, 124) is eliminated (i.e., the elastic members (123, 124) extend in the axial direction of the gate rotor (50)). Thus, the front surface (50*a*) of each gate rotor (50) is not too far from the sealing surface (21) of the cylindrical wall (20). The distance d between the front surface (50*a*) and the sealing surface (21) is therefore adjusted to the predetermined distance D.

Such a configuration of the seventh embodiment may have the similar advantages to those in the first embodiment. According to the seventh embodiment, when the front surface (50*a*) of the gate rotor (50) approaches the sealing surface (21) of the cylindrical wall (20) due to the thermal expansion of the gate rotor (50), the controller (129) of the gap adjuster mechanism (70) displaces the gate rotor (50), based on the temperature of the gate rotor chamber (17) detected by the temperature sensor (128), thereby automatically avoiding the contact between the front surface (50*a*) of the gate rotor (50) and the sealing surface (21) of the cylindrical wall (20). The detected value of the temperature is a physical quantity correlating to the distance between the front surface (50*a*) of the gate rotor (50) and the sealing surface (21) of the cylindrical wall (20).

In the seventh embodiment, only the back pressure space (122) may be formed by providing the elastic members (123,124), and the other elements may be omitted.

According to the above configuration, when the front surface (50*a*) of the gate rotor (50) approaches the sealing surface (21) of the cylindrical wall (20) due to the thermal expansion of the gate rotor (50) during an abnormal operation of the screw compressor (1), the pressure of the refrigerating machine oil (i.e., the oil film) that seals the gap increases, and the backward pressing force acting on the front surface (50*a*) of the gate rotor (50) due to the refrigerating machine oil thus increases. As a result, the elastic members (123, 124) are contracted by the pressing force, and the gate rotor (50) retracts backward in the axial direction, thereby avoiding contact between the front surface (50*a*) of the gate rotor (50) and the sealing surface (21) of the cylindrical wall (20).

On the other hand, when the thermal expansion of the gate rotor (50) is eliminated and the front surface (50*a*) of the gate rotor (50) moves away from the sealing surface (21) of the cylindrical wall (20), the pressure of the refrigerating machine oil (i.e., the oil film) that seals the gap decreases, and the backward pressing force acting on the front surface (50*a*) of the gate rotor (50) due to the refrigerating machine oil thus decreases. As a result, the contraction of the elastic members (123, 124) is eliminated, and the gate rotor (50) moves forward in the axial direction.

Thus, also in the case of the seventh embodiment in which only the back pressure space (122) is formed by providing the elastic members (123, 124), even when the front surface (50*a*) of the gate rotor (50) approaches the sealing surface (21) of the cylindrical wall (20) due to the thermal expansion of the gate rotor (50), the gap adjuster mechanism (70) displaces the gate rotor (50) in the axial direction, thereby avoiding contact between the front surface (50*a*) of the gate rotor (50) and the sealing surface (21) of the cylindrical wall (20).

Other Embodiments

In the above embodiments, the high pressure refrigerating machine oil in the screw compressor (1) is supplied to the fluid circuit (80) of the gap adjuster mechanism (70) so that the gate rotor (50) is driven by the pressure of the refrigerating machine oil. However, instead of the refrigerating machine oil, the gas refrigerant in the high pressure state may be supplied to the fluid circuit (80) so that the gate rotor (50) may be driven by the pressure of the gas refrigerant.

In the above embodiments, the gap adjuster mechanism (70) may be configured such that the gate rotor (50) is driven by a motor, instead of by the pressure of the high pressure refrigerating machine oil in the screw compressor (1) or by the pressure of the gas refrigerant.

In the first to third embodiments, the gap adjuster mechanism (70) may be configured such that the distance d between the front surface (50*a*) of the gate rotor (50) and the sealing surface (21) of the cylindrical wall (20) is detected not based on the increase or decrease in pressure in the first passage (81) of the fluid circuit (80), but based on an electric signal from a non-contact sensor, such as a gap sensor.

In the fifth to seventh embodiments, the gap adjuster mechanism (70) may be configured such that at least one of the gate rotor (50) and the sealing surface (21) of the cylindrical wall (20) is displaced in the axial direction of the gate rotor (50) in order to avoid the contact between the front surface (50*a*) of the gate rotor (50) and the sealing surface (21) of the cylindrical wall (20), using a non-contact sensor such as a gap sensor instead of using the temperature sensors (104*a*, 112, and 128).

The gap adjuster mechanism (70) may be configured such that both of the gate rotor (50) and the sealing surface (21) of the cylindrical wall (20) may be displaced in the axial direction of the gate rotor (50) in order to avoid the contact between the front surface (50*a*) of the gate rotor (50) and the sealing surface (21) of the cylindrical wall (20).

As can be seen from the foregoing description, the present invention is useful as a single-screw compressor having a screw rotor and a gate rotor.

What is claimed is:

1. A single-screw compressor, comprising:

a screw rotor provided with a helical groove;

a cylindrical wall housing the screw rotor such that the screw rotor is rotatable;

a gap adjuster mechanism; and a gear-shaped gate rotor having a plurality of flat gates, the gate rotor being arranged outside the cylindrical wall, and some of the plurality of flat gates entering a space inside the cylindrical wall via an opening formed in the cylindrical wall and meshing with the screw rotor so that the gate rotor rotates together with the screw rotor, and a fluid being compressed in a compression chamber defined in the helical groove by the screw rotor, the plurality of flat gates meshing with the screw rotor, and the cylindrical wall, and the gap adjuster mechanism being configured to avoid contact between a front surface of the gate rotor toward the compression chamber and a sealing surface of the cylindrical wall facing the front surface by displacing at least one of the gate rotor and the sealing surface of the cylindrical wall in an axial direction of the gate rotor.

2. The single-screw compressor of claim 1, wherein the gate rotor is displaceable in the axial direction, and the gap adjuster mechanism is further configured to displace the gate rotor in the axial direction so that a distance between the front surface of the gate rotor and the sealing surface of the cylindrical wall is a predetermined distance.

3. The single-screw compressor of claim 2, wherein the gap adjuster mechanism includes a first cylinder chamber on which a first pressure acts, the first pressure varying according to an increase or a decrease in the distance between the front surface of the gate rotor and the sealing surface of the cylindrical wall, a second cylinder chamber on which a second pressure acts, the second pressure being constant, and a piston provided between the first cylinder chamber and the second cylinder chamber so as to be displaceable in an arrangement direction of the first and second cylinder chambers, and the gate rotor is configured to be displaced in the axial direction in association with displacement of the piston.

4. The single-screw compressor of claim 3, wherein the gap adjuster mechanism further includes a first passage connecting the first cylinder chamber and a gap between the front surface of the gate rotor and the sealing surface of the cylindrical wall, a high pressure fluid passage in which a fluid in a high pressure state flows, and a pressure regulating valve provided at the high pressure fluid passage so as to adjust a pressure of the fluid flowing in the high pressure fluid passage to a constant high pressure, and the first passage is connected to a downstream side of the pressure regulating valve of the high pressure fluid passage via a throttle.

5. The single-screw compressor of claim 4, wherein the gap adjuster mechanism further includes a second passage connecting the second cylinder chamber to the downstream side of the pressure regulating valve of the high pressure fluid passage, and the pressure regulating valve is configured to adjust the pressure of the fluid flowing in the high pressure fluid passage to the second pressure.

6. The single-screw compressor of claim 5, further comprising:

a support member supporting the gate rotor from a back side opposite to the compression chamber; and a holder rotatably supporting the support member, the holder being displaceable in the axial direction of the gate rotor, the first and second cylinder chambers being provided on an outer periphery of the holder, and the first and second cylinder chambers being arranged in the axial direction of the gate rotor, and the piston being integrated with the holder.

7. The single-screw compressor of claim 4, wherein the gap adjuster mechanism further includes a second passage connecting the second cylinder chamber to an upstream side of the pressure regulating valve of the high pressure fluid passage, and a second pressure regulating valve provided at the second passage so as to maintain a pressure of the fluid flowing in the second passage at the second pressure.

8. The single-screw compressor of claim 7, further comprising:

a support member supporting the gate rotor from a back side opposite to the compression chamber; and a holder rotatably supporting the support member, the holder being displaceable in the axial direction of the gate rotor, the first and second cylinder chambers being provided on an outer periphery of the holder, and the first and second cylinder chambers being arranged in the axial direction of the gate rotor, and the piston being integrated with the holder.

9. The single-screw compressor of claim 3, further comprising:

a support member supporting the gate rotor from a back side opposite to the compression chamber; and a holder rotatably supporting the support member, the holder being displaceable in the axial direction of the gate rotor, the first and second cylinder chambers being provided on an outer periphery of the holder, and the first and second cylinder chambers being arranged in the axial direction of the gate rotor, and the piston being integrated with the holder.

10. The single-screw compressor of claim 4, further comprising:

a support member supporting the gate rotor from a back side opposite to the compression chamber; and a holder rotatably supporting the support member, the holder being displaceable in the axial direction of the gate rotor, the first and second cylinder chambers being provided on an outer periphery of the holder, and the first and second cylinder chambers being arranged in the axial direction of the gate rotor, and the piston being integrated with the holder.

11. The single-screw compressor of claim 1, wherein the gap adjuster mechanism includes a detection section configured to detect a distance between the front surface of the gate rotor and the sealing surface of the cylindrical wall or a physical quantity correlating to the distance, and the gap adjuster mechanism is further configured to displace at least one of the gate rotor and the sealing surface of the cylindrical wall in the axial direction of the gate rotor, based on a value detected by the detection section in order to avoid contact between the front surface of the gate rotor and the sealing surface of the cylindrical wall.

* * * * *